US006860041B2

(12) United States Patent
Sakai et al.

(10) Patent No.: US 6,860,041 B2
(45) Date of Patent: Mar. 1, 2005

(54) SNOW REMOVAL MACHINE

(75) Inventors: Seishu Sakai, Wako (JP); Nobuo Yamazaki, Wako (JP); Tosao Satake, Susaki (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/761,958

(22) Filed: Jan. 21, 2004

(65) Prior Publication Data

US 2004/0172859 A1 Sep. 9, 2004

(30) Foreign Application Priority Data

Jan. 21, 2003 (JP) ..... 2003-012790

(51) Int. Cl.[7] ..... E01H 5/09
(52) U.S. Cl. ..... 37/250; 37/258
(58) Field of Search ..... 37/258, 257, 250, 37/249, 350

(56) References Cited

U.S. PATENT DOCUMENTS 3,913,247 A * 10/1975 Ruhl ..... 37/258
4,783,915 A * 11/1988 Sasaki et al. ..... 37/251
4,899,471 A * 2/1990 Sasaki et al. ..... 37/233

FOREIGN PATENT DOCUMENTS

| | | | |
|---|---|---|---|
| JP | 58-76623 | * | 5/1983 |
| JP | 03137311 | | 6/1991 |
| JP | 6-193025 | * | 7/1994 |

* cited by examiner

*Primary Examiner*—Christopher J. Novosad
(74) *Attorney, Agent, or Firm*—Adams & Wilks

(57) ABSTRACT

A snow removal machine has first and second augers mounted on respective auger shafts. Each of the first and second augers has an outer helical auger blade, an intermediate helical auger blade and an inner helical auger blade. The outer helical auger blade and the inner helical auger blade of each of the first and second augers are disposed along a common first helical path and are spaced-apart from one another along a rotational axis of the corresponding auger shaft. The intermediate helical auger blade of each of the first and second augers is disposed along a second helical path angularly shifted substantially 180 degrees with respect to the first helical path.

14 Claims, 14 Drawing Sheets

SNOW REMOVAL MACHINE

BACKGROUND OF THE INVENTION

1. Field of the Invention

The present invention relates generally to a snow removal machine and, more particularly, to an improvement in an auger device for collecting snow.

2. Background Information

As a snow removal machine with an auger of such a type, a snow removal machine disclosed, for example, in JP-A-3-137311 is known. This snow removal machine will be described with reference to FIG. 15.

An auger device 200 shown in FIG. 15 has left and right augers 203 and 204 mounted on left and right auger shafts 201 and 202, respectively.

The left auger 203 has a first auger blade 205 and a second auger blade 206 which is 180° out of phase with the first auger blade 205.

Like the left auger 203, the right auger 204 has a first auger blade 205 and a second auger blade 206 which is 180° out of phase with the first auger blade 205.

The left and right augers 203 and 204 are rotated as shown by arrows via the left and right auger shafts 201 and 202 to break snow with four blades of the first auger blades 205, 205 and the second auger blades 206, 206. The broken up snow is collected at the center of the machine width by the four blades 205, 205, 206 and 206.

The snow collected at the center of the machine width is whirled up with a blower 207 and thrown away via a chute not shown.

The first auger blade 205 is continuous substantially by one pitch (360°). The second auger blade 206 is also continuous substantially by one pitch (360°). More specifically, the first auger blade 205 forms substantially a pitch of a spiral between its outer end 205*a* and inner end 205*b*. Likewise, the second auger blade 206 forms substantially a pitch of a spiral between its outer end 206*a* and inner end 206*b*. The left and right augers 203 and 204 are thus each configured with two one-pitch blades combined 180° out of phase with one another and mounted on the auger shafts 201 and 202 via coupling members 220. The left and right augers 203 and 204 thus have increased weight, requiring a large output of an engine for driving the left and right augers 203 and 204, and preventing an improvement in engine fuel efficiency and a reduction in size of an auger driving engine.

During a snow removing operation, a foreign matter 208 such as a stone buried in snow can be caught in a gap 210 between the first auger blade 205 and an auger housing 209 or in a gap 210 between the second auger blade 206 and the auger housing 209.

The first auger blade 205 is a long length of material continuous in a pitch of a spiral. The second auger blade 206 is also a long length of material continuous in a pitch of a spiral. It is thus necessary to rigidly fix the auger blades 205 and 206 at multiple points to the left and right auger shafts 201 and 202.

When a foreign matter 208 enters the gap 210, the first and second auger blades 205 and 206 press the foreign matter 208 against the auger housing 209, increasing the frequency of catching the foreign matter 208 in the gap 210.

In addition, since the first and second auger blades 205 and 206 are long elements continuous in a pitch of a spiral, when a foreign matter 208 gets trapped in the gap 210, it is difficult to release the foreign matter 208. This further increases the frequency of catching the foreign matter 208 in the gap 210.

When the foreign matter 208 gets caught in the gap 210, it is necessary to remove the foreign matter 208 from the gap 210, which is burdensome for an operator.

Moreover, while the foreign matter 208 caught is removed from the gap 210, the auger device 200 should be stopped. The auger device 200 is thus stopped for a longer period of time, thus preventing enhanced workability.

It is thus desired to reduce the weight of an auger, reduce the frequency of catching stones between an auger blade and an auger housing, and improve the straight advancement of an auger device.

SUMMARY OF THE INVENTION

According to the present invention, there is provided a snow removal machine comprising: left and right auger shafts extending from a transverse center of the machine leftward and rightward, respectively; and left and right augers each having an outer auger blade, an intermediate auger blade and an inner auger blade which extend helically and mounted in the mentioned order from outside toward the transverse center on the left or right auger shaft for collecting snow to the center, wherein the outer auger blade and the inner auger blade are positioned along a common first helical path and the intermediate auger blade is positioned along a second helical path phase-shifted substantially 180° with respect to the first helical path.

The arrangement of the outer auger blade and inner auger blade along the common first helical path and the arrangement of the intermediate auger blade along the second helical path approximately 180° out of phase with the first helical path allow the intermediate auger blade (that is, the second helix) to break snow at the same time when the outer auger blade or inner auger blade (that is, the first helix) breaks snow.

Snow cut off by two helixes of the first helix and the second helix is collected to the center in the transverse direction. Specifically, snow cut off by the outer auger blade, for example, is carried by the outer auger blade to the intermediate auger blade, and then carried by the intermediate auger blade to the inner auger blade. The snow carried to the inner auger blade is carried to the center in the transverse direction by the inner auger blade, so that the snow cut off by the auger is collected to the center in the transverse direction, accordingly.

As described above, the first and second helical blades being 180° out of phase with one another are comprised of only three members, the outer auger blade, inner auger blade and intermediate auger blade, resulting in a reduced weight of the auger device and a reduced output of an auger driving engine for rotating the auger device. The three-part division of the auger into the outer auger blade, intermediate auger blade and inner auger blade allows each of the auger blades to be made small, mounted at one point on the auger shaft, and plastically deformable to some degree. When a foreign matter is caught in a gap between an auger blade and an auger housing, the auger blade can be plastically deformed to release the foreign matter from between the auger blade and the auger housing while the auger keeps rotating. If the foreign matter is not released naturally, an operator can easily remove the foreign matter caught in by plastically deforming the auger blade.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Figure 1:
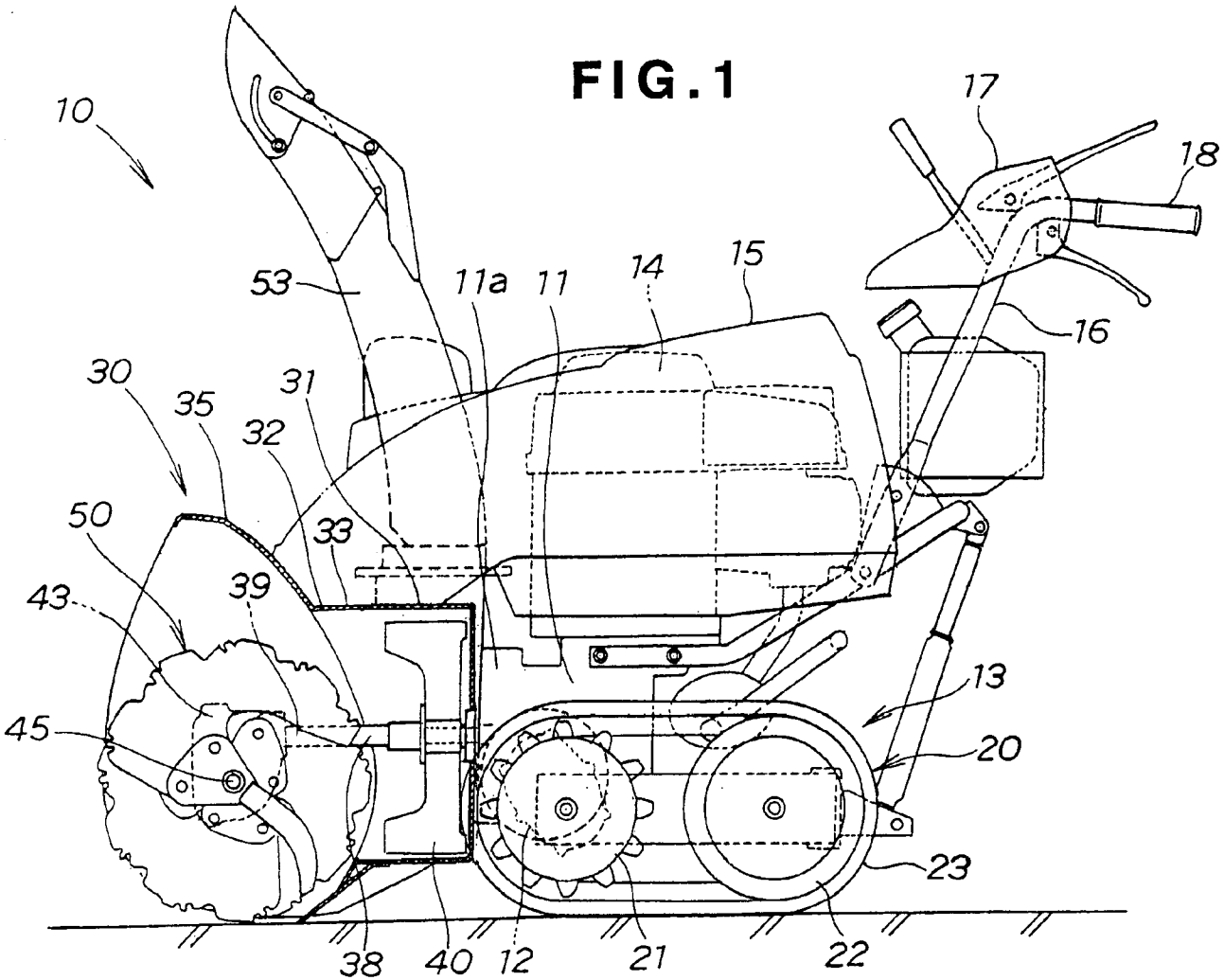
FIG. 1 is a side view of a snow removal machine according to the present invention.

A snow removal machine 10 according to the present invention shown in FIG. 1 is a self-propelled, walk-behind working machine lead by an operator walking behind an operating panel 17, holding grips 18 (only left grip 18 shown) of left and right operating handles 16. The snow removal machine 10 has a body 11 formed by a transmission case.

Drive electric motors 12 (only left motor shown) are mounted to left and right lower portions of the body 11. A running section 13 is connected to the left and right electric motors 12. An engine 14 is mounted on an upper portion of the body 11. An auger device 30 driven by the engine 14 is mounted to a front portion of the body 11. The rear of the auger device 30 and the engine 14 are covered with a cover 15. The left and right operating handles 16 (only left operating handle 16 shown) extend in a rearward upward direction from upper portions of the body 11. The operating panel 17 is mounted between the left and right operating handles 16.

The running section 13 includes a left running unit 20 provided outside the left electric motor 12 and a right running unit (not shown) provided outside the right drive motor (not shown). The right running unit is configured the same as the left running unit 20 and will not be described.

The left running unit 20 has a left drive wheel 21 connected to the left electric motor 12, a left idler wheel 22 provided rotatably behind the left drive wheel 21, and a left crawler belt 33 running between the left drive wheel 21 and the left idler wheel 32. The left crawler belt 23 is rotated by driving the left drive wheel 21 with the left electric motor 12.

The snow removal machine 10 is propelled by rotating the left and right crawler belts 23 of the running section 13 with the left and right electric motors 12, with the auger device 30 driven by the engine 14, for performing snow removing operation.

The auger device 30 will be described in detail below.

The auger device 30 includes a blower housing 31 provided to a front portion 11*a* of the body 11.

An auger housing 35 is provided to a front portion 32 of the blower housing 31. A drive shaft 38 extends forward from the engine 14. The drive shaft 38 extends through the blower housing 31 into the auger housing 35. A blower 40 disposed in the blower housing 31 is mounted on a middle portion of the drive shaft 38. A distal end portion 39 of the drive shaft 38 is connected to a power transmission member 43 (so-called auger mission) disposed centrally in a transverse direction of the snow removal machine 10 (i.e., a transverse center of the snow removal machine). Left and right auger shafts 45, 46 (see FIG. 2 for the right auger shaft 46) extend left and right from the power transmission member 43. Left and right augers 50 and 51 are mounted on the left and right auger shafts 45 and 46 (see FIG. 2 for the right auger 51).

When the drive shaft 38 is rotated by drive of the engine 14, the blower 40 is rotated via the drive shaft 38, and the left and right auger shafts 45 and 46 are rotated via the power transmission member 43. The left and right augers 50 and 51 are rotated by the rotation of the left and right auger shafts 45 and 46.

When the snow removal machine 10 travels under this state, the left and right augers 50 and 51 cut into accumulated snow for breaking the snow. The broken up snow is collected with the left and right augers 50 and 51 in the blower housing 31 located centrally in the transverse direction.

The snow collected in the blower housing 31 is whirled up by the blower 40 and thrown through a chute 53 provided on an upper portion 33 of the blower housing 31 away to a desired area.

Figure 2:
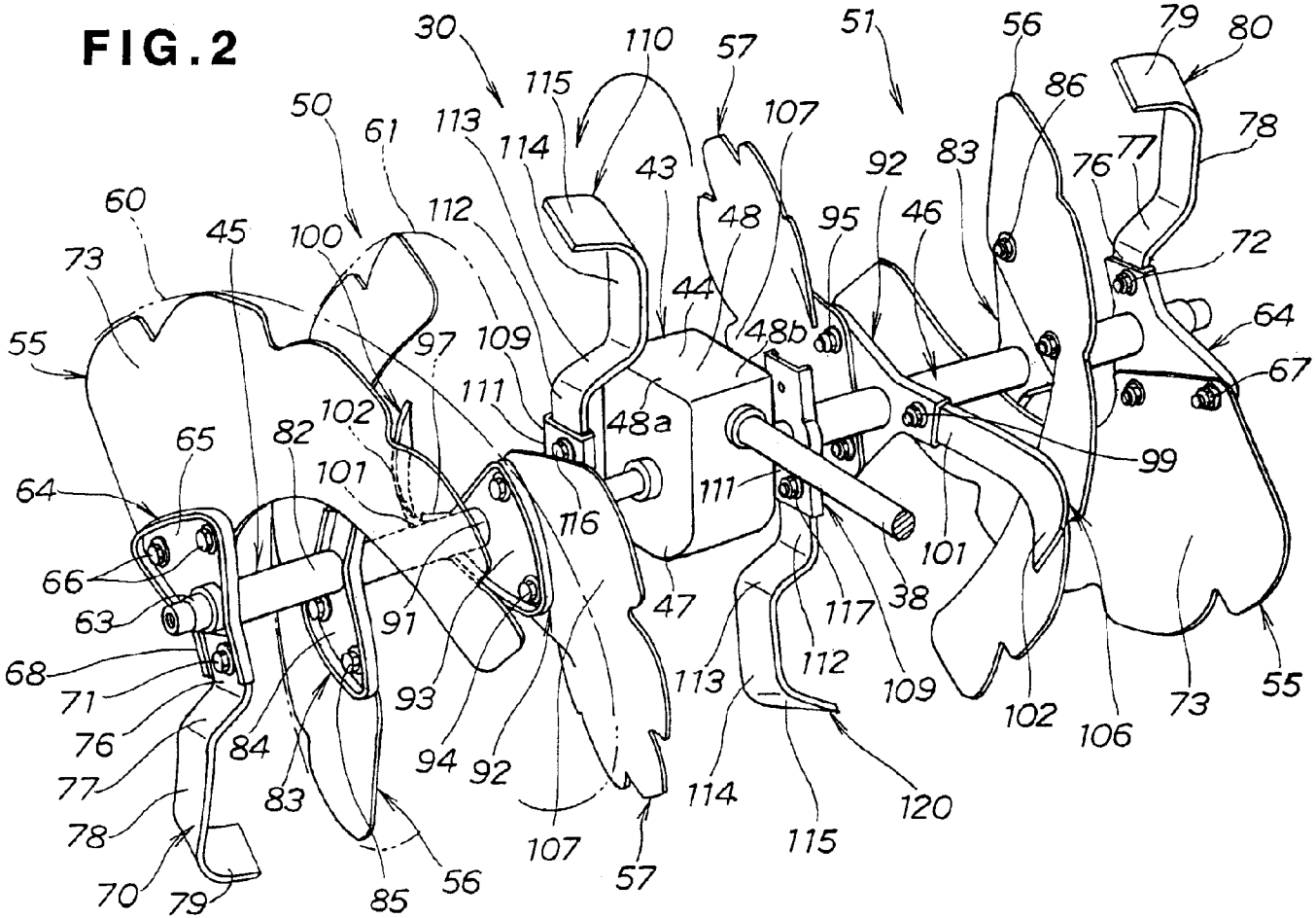
FIG. 2 is a perspective view of an auger device shown in FIG. 1.

FIG. 2 illustrates the auger device 30 in a perspective view. The auger device 30 includes the left auger 50 and the right auger 51.

The left auger 50 has an outer auger blade 55, an intermediate auger blade 56 and an inner auger blade 57 provided on the left auger shaft 45 in this order from outside toward the center in the transverse direction. The outer auger blade 55 and the inner auger blade 57 are arranged along a common first helical path 60. The intermediate auger blade 56 is arranged along a second helical path 61 which is approximately 180° out of phase with the first helical path 60.

The right auger 51 is approximately 180° out of phase with the left auger 50. The right auger 51 includes an outer auger blade 55, an intermediate auger blade 56 and an inner auger blade 57 which are provided on the right auger shaft 46 in this order from outside toward the center in the transverse direction.

The right auger 51 is configured the same as the left auger 50 except that it is 180° out of phase with the left auger 50. Components of the right auger 51 are thus numbered the same and the right auger 51 will not be described.

The three-part division of the left auger 50 into the outer auger blade 55, intermediate auger blade 56 and inner auger blade 57 results in the small-size formation of the auger blades 55, 56 and 57. Each of the auger blades 55, 56 and 57 can thus be mounted on the auger shaft 45 at a single point.

An outer supporting member 64 is mounted on an outer portion 63 of the left auger shaft 45. The outer auger blade 55 is mounted to a blade holder 65 of the outer supporting member 64 with bolts 66, 66 and nuts 67, 67 (for the nuts 67, see an outer auger blade 55 on the right auger shaft 46). A left attitude stabilizing tine 70 is mounted to a tine holder 68 of the outer supporting member 64 with a bolt 71 and a nut 72. The left attitude stabilizing tine 70 is arranged in the vicinity of the outer auger blade 55.

Figure 3:
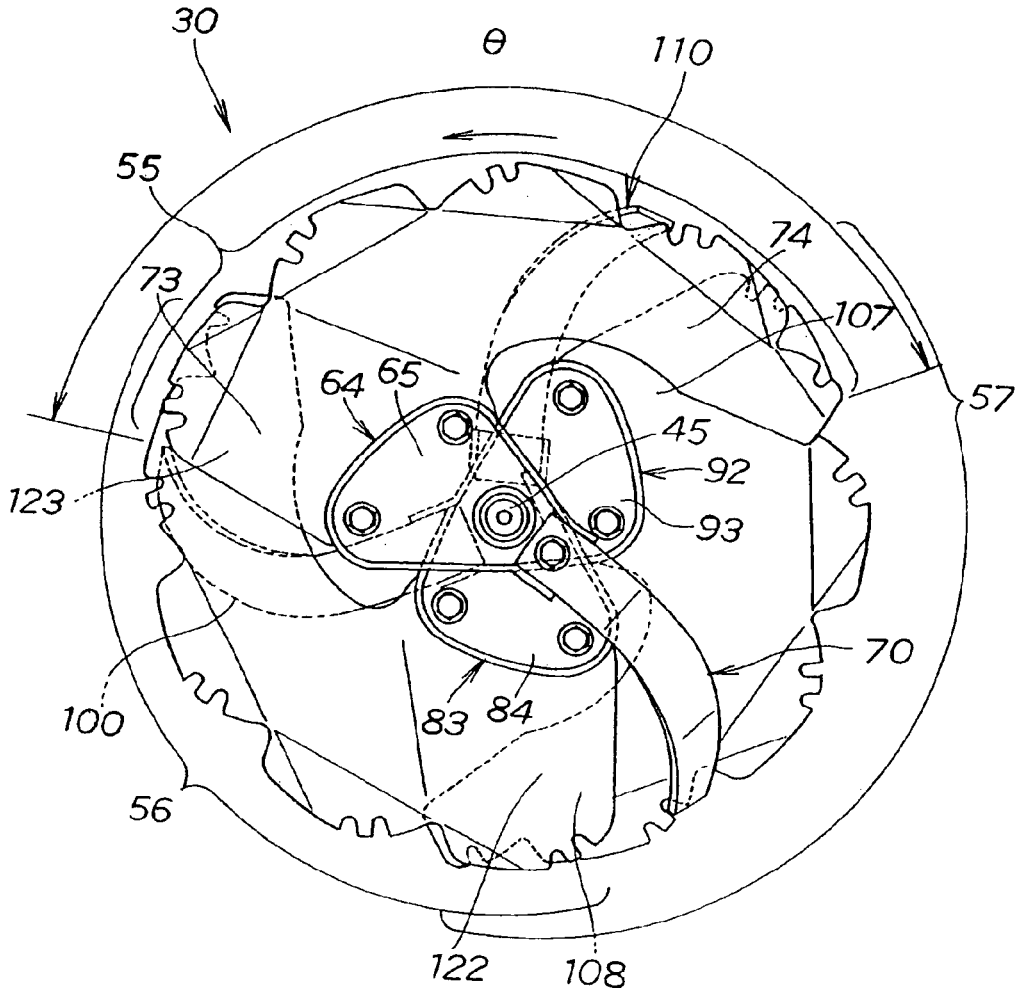
FIG. 3 is a side view of the auger device shown in FIG. 2.
Figure 4:
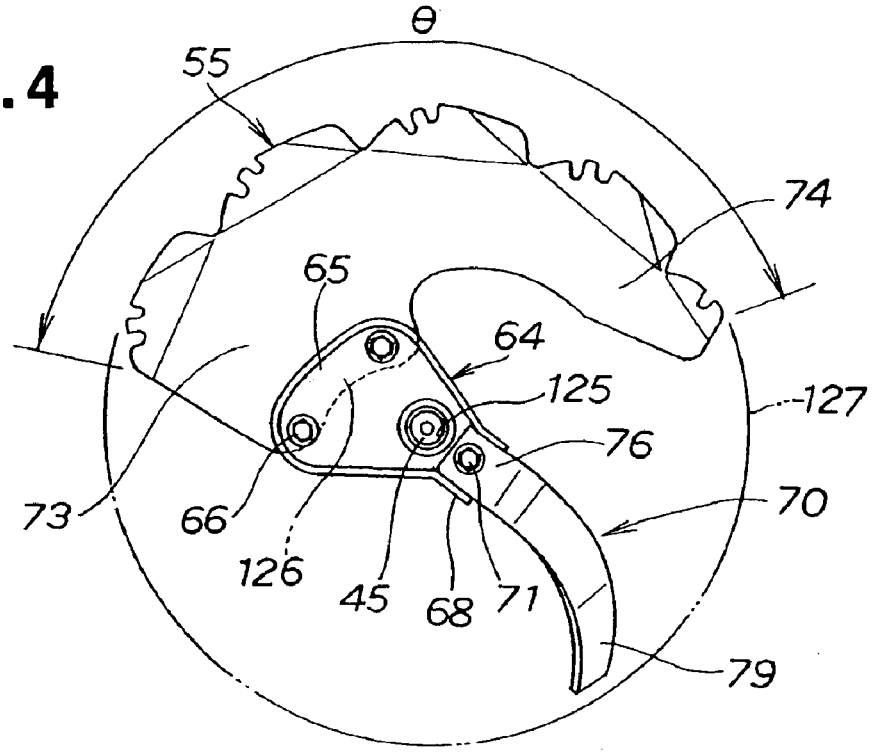
FIG. 4 is a side view of an outer auger blade and a left attitude stabilizing tine shown in FIG. 2.

The left attitude stabilizing tine 70 is arranged approximately 180° out of phase with a front end portion 73 of the outer auger blade 55 (see FIGS. 3 and 4). The left attitude stabilizing tine 70 is thus arranged in phase with a front end portion 73 of the outer auger blade 55 provided on the right auger shaft 46.

The left attitude stabilizing tine 70 includes a proximal end portion 76 placed on the tine holder 68 of the outer supporting member 64, a bend 77 bent outward from the proximal end portion 76, an extension 78 extending radially outward from the bend 77, and a claw 79 bent inward from the extension 78.

The proximal end portion 76, bend 77 and extension 78 are formed with a fixed width. The claw 79 is formed with a width slightly narrower than that of the proximal end portion 76, bend 77 and extension 78. The left attitude stabilizing tine 70 is formed in a substantially U shape with the bend 77, extension 78 and claw 79.

The proximal end portion 76, bend 77, extension 78 and claw 79 shown in FIG. 2 are not limited to those widths and the widths thereof may be determined as appropriate.

The proximal end portion 76 of the left attitude stabilizing tine 70 is placed on the tine holder. 68. The bolt 71 is inserted through the tine holder 68 and the proximal end portion 76 and the nut 72 is fastened to the bolt 71 (see a right attitude stabilizing tine 80 for the nut 72), whereby the left attitude stabilizing tine 70 is mounted to the tine holder 68 of the outer supporting member 64.

Figure 8:
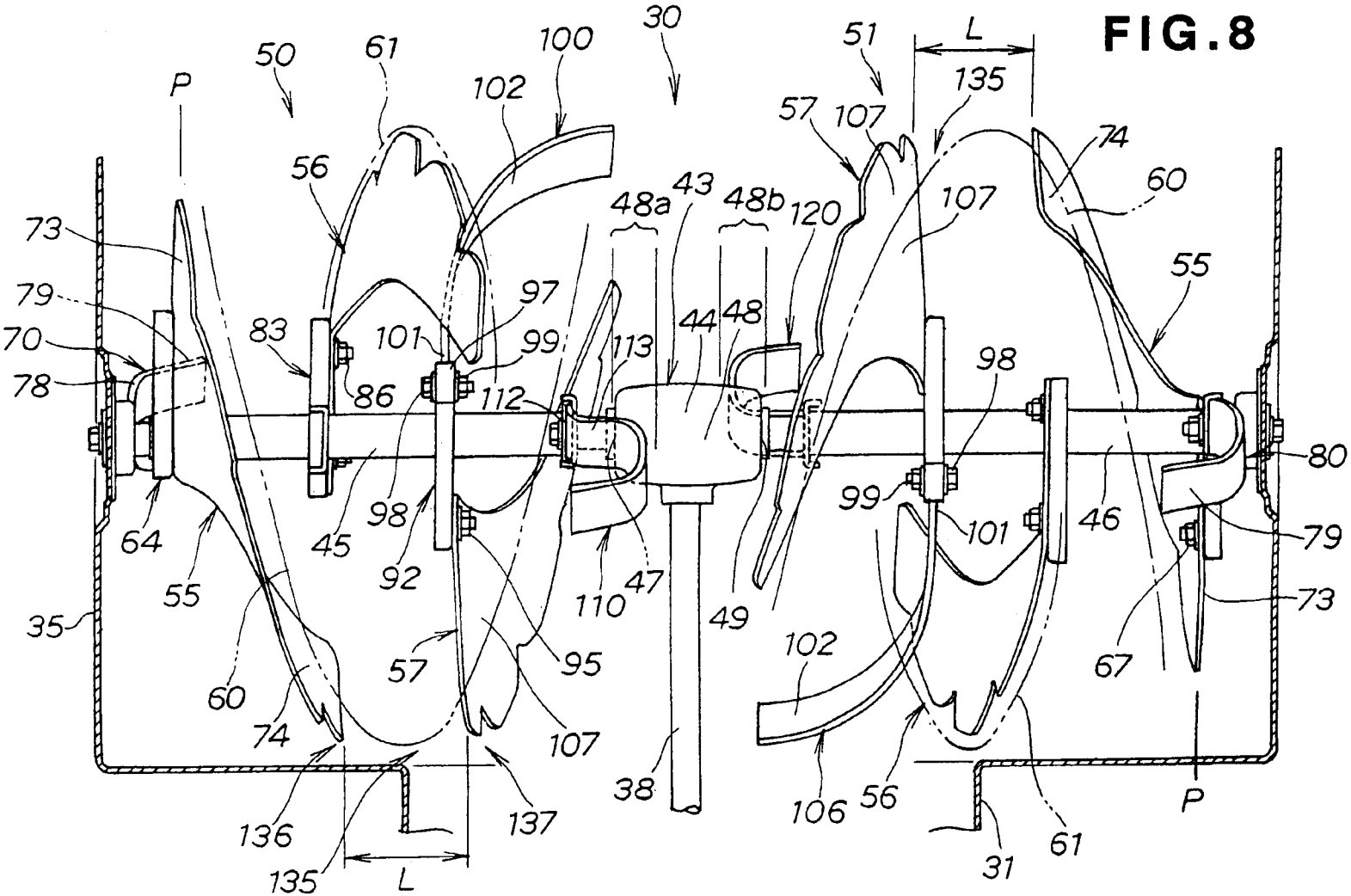
FIG. 8 is a plan view of the auger device shown in FIG. 2.

The substantially U-shaped formation of the left attitude stabilizing tine 70 with the bend 77, extension 78 and claw 79 causes the claw 79 to be located in substantially the same position P as the front end portion 73 of the outer auger blade 55 in the transverse direction as shown in FIG. 8.

Like the left attitude stabilizing tine 70, the right attitude stabilizing tine 80 is arranged approximately 180° out of phase with a front end portion 73 of the outer auger blade 55 on the right auger shaft 46 (see also FIG. 3). The right attitude stabilizing tine 80 is thus arranged in phase with the front end portion 73 of the outer auger blade 55 provided on the left auger shaft 45.

The right attitude stabilizing tine 80 is configured the same as the left attitude stabilizing tine 70. Components of the right attitude stabilizing tine 80 are numbered the same as those of the left attitude stabilizing tine 70 and will not be described.

The reason why the left attitude stabilizing tine 70 is arranged in phase with the front end portion 73 of the outer auger blade 55 provided on the right auger shaft 46 and the right attitude stabilizing tine 80 is arranged in phase with the front end portion 73 of the outer auger blade 55 provided on the left auger shaft 45 will be described with reference to FIG. 14.

An intermediate supporting member 83 is mounted on an intermediate portion 82 of the left auger shaft 45. The intermediate auger blade 56 is mounted to a blade holder 84 of the intermediate supporting member 83 with bolts 85, 85 and nuts 86, 86 (see FIG. 8 for the nuts 86).

An inner supporting member 92 is mounted on an inner portion 91 of the left auger shaft 45. The inner auger blade 57 is mounted to a blade holder 93 of the inner supporting member 92 with bolts 94, 94 and nuts 95, 95 (see FIG. 8 as to the nuts 95). A left driving tine 100 is provided to a tine holder 97 of the inner supporting member 92 with a bolt 98 and a nut 99 (see FIG. 8) so that the left driving tine 100 is arranged in the vicinity of the inner auger blade 57.

Figure 6:
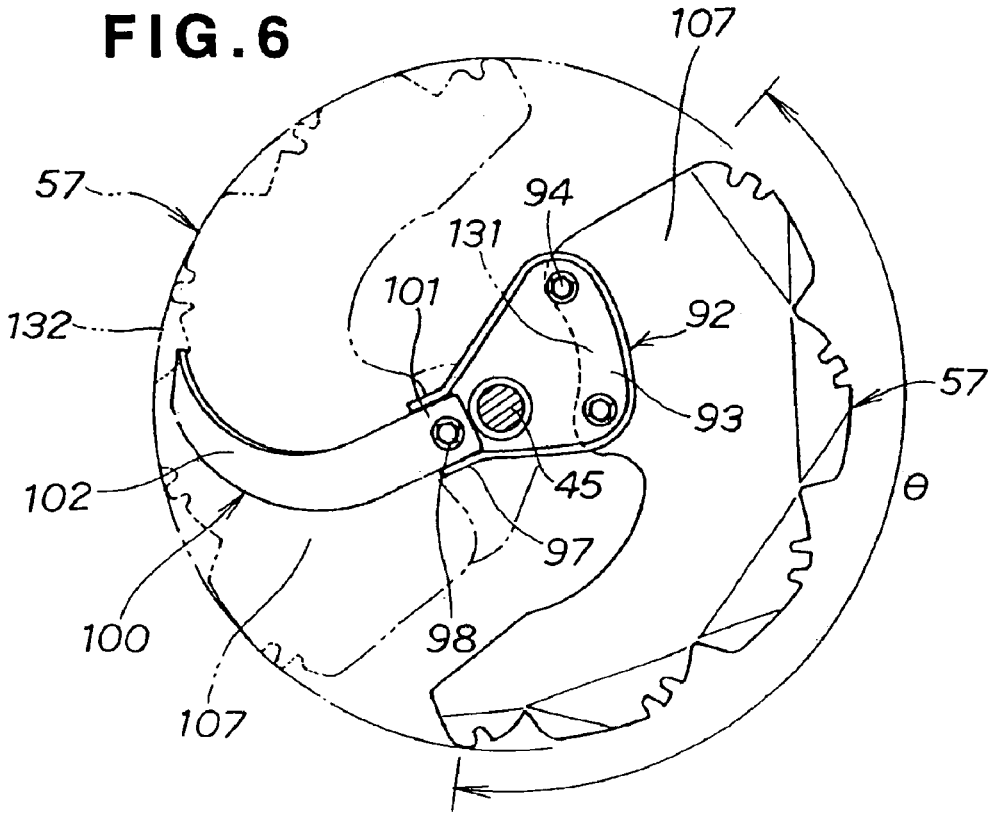
FIG. 6 is a side view of an inner auger blade and a left driving tine shown in FIG. 2.

The left driving tine 100 is phase-shifted approximately 180° with respect to the inner auger blade 57 (see also FIGS. 3 and 6) so as to be opposite to a front end portion 107 of the inner auger blade 57 provided on the right auger shaft 46 (see also FIGS. 6 and 8).

The left driving tine 100 includes a proximal end portion 101 placed on the tine holder 97 of the inner supporting member 92 and a curved claw 102 bent inward in a curve from the proximal end portion 101 (see also FIGS. 6 and 8).

The proximal end portion 101 is formed with a fixed width. The curved claw 102 is formed with a width slightly narrower than that of the proximal end portion 101.

The proximal end portion 101 and the curved claw 102 are not limited to those widths and the widths thereof may be determined as appropriate.

The proximal end portion 101 of the left driving tine 100 is placed on the tine holder 97, the bolt 98 is inserted into the tine holder 97 and the proximal end portion 101 as shown in FIG. 8, and the nut 99 is fastened to the bolt 98, whereby the left driving tine 100 is mounted to the tine holder 97 of the inner supporting member 92.

Like the left driving tine 100, a right driving tine 106 is arranged approximately 180° out of phase with the inner auger blade 57 on the right auger shaft 46 (see also FIG. 8) so as to be opposite to a front end portion 107 of the inner auger blade 57 provided on the left auger shaft 46.

The right driving tine 106 is configured the same as the left driving tine 100. Components of the right driving tine 106 are numbered the same as those of the left driving tine 100 and will not be described.

The reason why the left and right driving tines 100 and 106 are configured as described above will be described in detail with reference to FIGS. 12A and 12B.

The outer auger blades 55, the intermediate auger blades 56, and the inner auger blades 57 are members of an identical shape.

The outer supporting members 64, the intermediate supporting members 83, and the inner supporting members 92 are members of an identical shape.

A supporting member 109 is mounted inside the inner supporting member 92 on the left auger shaft 45, in the vicinity of the power transmission member 43. The supporting member 109 is provided with a left snow removing tine 110. The left snow removing tine 110 is arranged out of phase with the front end portion 107 of the right inner auger blade 57 at a predetermined angle (e.g., approximately 30° in a counterclockwise direction) (see also FIG. 3). The predetermined angle of 30° may be changed as desired.

The left snow removing tine 110 is bolted to a tine holder 111 of the supporting member 109.

The left snow removing tine 110 includes a proximal end portion 112 mounted to the tine holder 111, a bend 113 bent inward from the proximal end portion 112, an extension 114 extending radially outward from the bend 113, and a claw 115 bent outward from the extension 114.

The proximal end portion 112, bend 113 and extension 114 are formed with a fixed width. The claw 115 is formed with a width slightly narrower than that of the proximal end portion 112, bend 113 and extension 114. The left snow removing tine 110 is formed in a substantially U shape with the bend 113, extension 114 and claw 115.

The proximal end portion 112, bend 113, extension 114 and claw 115 are not limited to those widths and the widths thereof may be determined as appropriate.

The proximal end portion 112 of the left snow removing tine 110 is placed on the supporting member 109, a bolt 116 is inserted into the tine holder 111 of the supporting member 109 and the proximal end portion 112, and a nut is fastened to the bolt 116 (for the nut 117, see a right snow removing tine 120), whereby the left snow removing tine 110 is mounted to the supporting member 109.

At that time, the proximal end portion 112 of the left snow removing tine 110 is proximately opposed to a left external wall 47 of the power transmission member 43.

The bend 113 of the left snow removing tine 110 is opposed to a left peripheral wall portion 48*a* as a left half of a peripheral wall (upper or lower wall or front or rear wall) of the power transmission member 43.

Like the left snow removing tine 110, the right snow removing tine 120 is bolted to a tine holder 111 of a supporting member 109 mounted in the vicinity of the power transmission member 43, inside of the inner supporting member 92 on the right auger shaft 45.

The right snow removing tine 120 has the same shape as that of the left snow removing tine 110. Components of the right snow removing tine 120 are numbered the same as those of the left snow removing tine 110 and will not be described.

The reason why the left attitude stabilizing tine 70 is arranged in phase with the front end portion 73 of the outer auger blade 55 provided on the right auger shaft 46 and the right attitude stabilizing tine 80 is arranged in phase with the front end portion 73 of the outer auger blade 55 provided on the left auger shaft 45, as described above, will be described with reference to FIG. 14.

As shown in FIG. 3, the auger device 30 is configured such that the inner auger blade 57 is displaced 120° rearward around the auger shaft with respect to the outer auger blade 55, and the intermediate auger blade 56 is displaced 120° rearward around the auger shaft with respect to the inner auger blade 57.

The outer auger blade 55, intermediate auger blade 56 and inner auger blade 57 are arranged such that their respective peripheral angles θ are approximately 150°, for example.

A rear end portion of the outer auger blade 55 overlaps the front end portion 107 of the inner auger blade 57. A rear end portion 108 of the inner auger blade 57 overlaps a front end portion 122 of the intermediate auger blade 56. A rear end portion 123 of the intermediate auger blade 56 overlaps the front end portion 73 of the outer auger blade 55.

When the auger device 30 is rotated in a direction shown by an arrow and the outer auger blade 55, inner auger blade 57 and intermediate auger blade 56 break snow in this order, the inner auger blade 57 starts breaking snow before the outer auger blade 55 finishes breaking snow.

Then, the intermediate auger blade 56 starts breaking snow before the inner auger blade 57 finishes breaking snow.

Further, the outer auger blade 55 starts breaking snow before the intermediate auger blade 56 finishes breaking snow.

In this manner, the outer auger blade 55, inner auger blade 57 and intermediate auger blade 56 sequentially continuously break snow, increasing snow removing workability.

FIG. 4 illustrates the outer auger blade 55 and the left attitude stabilizing tine 70.

The left auger shaft 45 is fitted into a through hole 125 in the outer supporting member 64 which is then welded to the left auger shaft 45, thereby to join the outer supporting member 64 to the left auger shaft 45. The outer supporting member 64 has the blade holder 66 for mounting the outer auger blade 55 and the tine holder 68 for mounting the left attitude stabilizing tine 70. The blade holder 65 is approximately 180° off the tine holder 68.

The outer auger blade 55 is a curved blade with the peripheral angle θ set approximately at 150°, for example. The outer auger blade 55 has a mounting part 126 at an inside peripheral portion of the front end portion 73. The mounting part 126 is mounted to the blade holder 65 of the outer supporting member 64 with the bolts 66, 66 and nuts 67, 67 (for the nuts 67, see the outer auger blade 55 on the right auger shaft 46 shown in FIG. 2). The rear end portion 74 of the outer auger blade 55 is a free end.

The outer auger blade 55 is mounted to the blade holder 65 only at the single mounting part 126, so that the outer auger blade 55 is plastically deformable at its outside periphery to some degree.

The reason why the outer auger blade 55 is plastically deformable will be described with FIG. 12A.

The left attitude stabilizing tine 70 is mounted at its proximal end portion 76 to the tine holder 68 of the outer supporting member 64 with the bolt 71 and nut 72 (for the nut 72, see the right attitude stabilizing tine 80 shown in FIG. 2) to be displaced approximately 180° with respect to the front end portion 73 of the outer auger blade 55. The distal end of the claw 79 is located proximately along the peripheral path of the outer auger blade 55.

Figure 5:
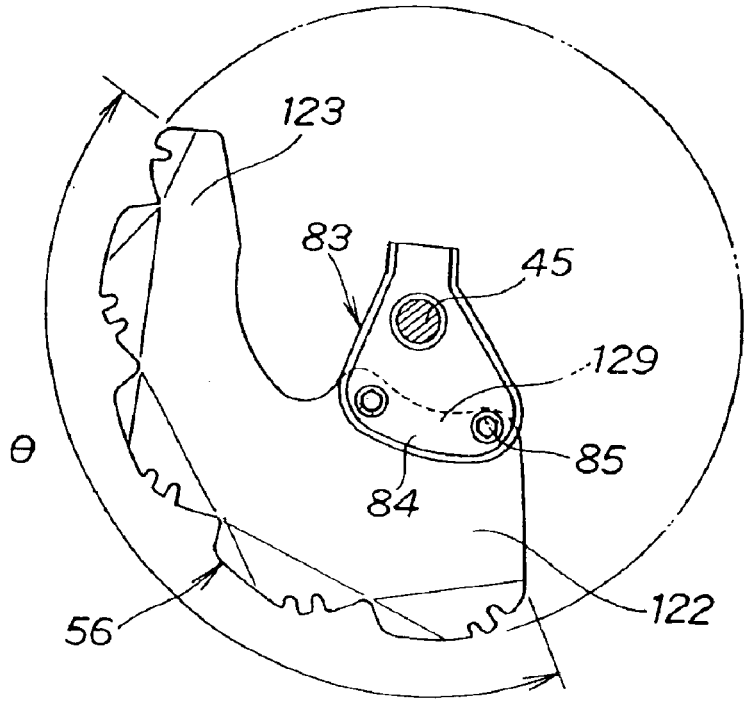
FIG. 5 is a side view of an intermediate auger blade shown in FIG. 2.

FIG. 5 illustrates the intermediate auger blade 56.

The intermediate supporting member 83 is identical with the outer supporting member 64 (see FIG. 4) and is displaced 240° clockwise with respect to the outer supporting member 64 (see FIG. 3).

The intermediate auger blade 56 has the same shape as that of the outer auger blade 55 (see FIG. 4). The intermediate auger blade 56 has a mounting part 129 at an inside peripheral portion of the front end portion 122. The mounting part 129 is mounted to the blade holder 84 of the intermediate supporting member 83 with the bolts 85, 85 and nuts 86, 86 (see FIG. 8 for the nuts 86). The intermediate auger blade 56 is displaced 240° clockwise with respect to the outer auger blade 55 (see FIG. 3).

The intermediate auger blade 56 is mounted to the blade holder 84 only at its mounting part 129, so that the intermediate auger blade 56 is plastically deformable to some degree at its outside periphery.

The reason why the intermediate auger blade 56 is plastically deformable will be described with reference to FIG. 12A.

FIG. 6 illustrates the inner auger blade 57 and the left driving tine 100.

The inner supporting member 92 has the same shape as that of the outer supporting member 64 shown in FIG. 4. The inner supporting member 92 is displaced 120° clockwise with respect to the outer supporting member 64.

The inner auger blade 57 has the same configuration as that of the outer auger blade 55 shown in FIG. 4. The inner auger blade 57 has a mounting part 131 at an inside peripheral portion of the front end portion 107. The mounting part 131 is mounted to the blade holder 93 of the inner supporting member 92 with the bolts 94, 94 and nuts 95, 95 (for the nuts 95, see the inner auger blade 57 on the right auger shaft 46 shown in FIG. 2).

The inner auger blade 57 is displaced 120° clockwise with respect to the outer auger blade 55.

The mounting part 131 of the inner auger blade 57 is mounted to the blade holder 93, so that the inner auger blade 57 is plastically deformable to some degree at its outside periphery.

The reason why the inner auger blade 57 is plastically deformable will be described with reference to FIG. 12.

The proximal end portion 101 of the left driving tine 100 is mounted to the tine holder 97 of the inner supporting member 92 with the bolt 98 and nut 99 (see FIG. 8 for the nut 99), so that the left driving tine 100 is displaced approximately 180° with respect to the front end portion 107 of the inner auger blade 57. The distal end of the curved claw 102 is located in the vicinity of a circle 132 along the peripheral path of the inner auger blade 57.

The circle 132 has the same radius as that of a circle 127 along the outside periphery of the outer auger blade 55 shown in FIG. 4.

The right auger 51 shown in FIG. 2 is 180° out of phase with the left auger 50. The left driving tine 100 is opposed to the front end portion 107 of the inner auger blade 57 (shown in imaginary lines) on the right auger shaft 46. The left driving tine 100 and the inner auger blade 57 on the right auger shaft 46 can take hold of a mass of snow entering between the left driving tine 100 and the inner auger blade 57 on the right auger shaft 46 to carry rearward.

Figure 7:
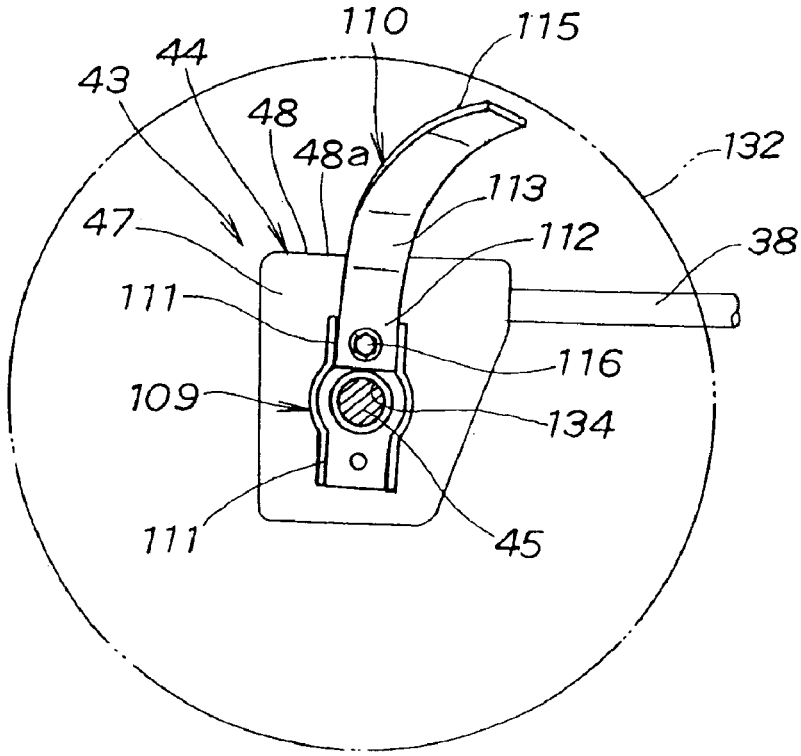
FIG. 7 is a side view of a left snow removing tine shown in FIG. 2.

FIG. 7 illustrates the left snow removing tine 110.

The left auger shaft 45 is fitted into a through hole in the supporting member 109 which is then welded to the left auger shaft 45, thereby to join the supporting member 109 to the left auger shaft 45. The supporting member 109 is displaced approximately 30° clockwise with respect to the inner supporting member 92 shown in FIG. 6. The supporting member 109 has a pair of tine holders 111, 111. The two tine holders 111, 111 are 180° off each other.

The left snow removing tine 110 is mounted to one of the pair of tine holders 111, 111 of the supporting member 109 (to the upper tine holder 111 in FIG. 7) via the bolt 116 and nut 117 (for the nut 117, see the right snow removing tine 120 shown in FIG. 2).

The left snow removing tine 110 is mounted on the left auger shaft 45 in such a manner as to be counterclockwise out of phase with the front end portion 107 of the inner auger blade 57 at a predetermined angle (e.g., approximately 30°) as shown in FIG. 3.

The distal end of the claw 115 is located in the vicinity of the circle 132 along the outside periphery of the inner auger blade 57.

As shown in FIG. 8, the auger device 30 includes the left auger 50 mounted on the left auger shaft 45 and the right auger 51 mounted on the right auger shaft 46. The right auger 51 is 180° out of phase with the left auger 50.

The left auger 50 has the outer auger blade 55, intermediate auger blade 56 and inner auger blade 57 arranged on the left auger shaft 45 in this order from outside to the center in the transverse direction.

Like the left auger 50, the right auger 51 has the outer auger lade 55, intermediate auger blade 56 and inner auger blade 57 arranged on the right auger shaft 46 in this order from outside to the center in the transverse direction.

The outer auger blade 55 and inner auger blade 57 are arranged along the common first helical path 60. The intermediate auger blade 56 is arranged along the second helical path 61 approximately 180° out of phase with the first helical path 60.

The three blades, the outer auger blade 55, inner auger blade 57 and intermediate auger blade 56, are each mounted at one end on the left or right auger shaft 45 or 46. That is, the three blades substantially constitute a pitch of a spiral (360°), eliminating the need for preparing two blades each constituting a pitch of a spiral as in a conventional manner, and resulting in a smaller number of blades. This leads to a reduction in weight of the auger device 30 and a reduction in output of the auger driving engine (operating engine) 14 (see FIG. 1) for rotating the auger device 30.

The outer auger blade 55 and the inner auger blade 57 are arranged along the first helical path 60. The rear end portion 74 of the outer auger blade 55 is laterally spaced from the front end portion 107 of the inner auger blade 57 with a clearance 135 of a predetermined interval L.

The reason why the rear end portion 74 of the outer auger blade 55 is spaced from the front end portion 107 of the inner auger blade 57 with the clearance 135 of the predetermined interval L will be described with reference to FIG. 12A.

The claw 79 of the left attitude stabilizing tine 70 is located in substantially the same position P as that of the front end portion 73 of the outer auger blade 55 on the left auger shaft 45 in the transverse direction.

The claw 79 of the right attitude stabilizing tine 80 is located in substantially the same position P as that of the front end portion 73 of the outer auger blade 55 on the right auger shaft 46 in the transverse direction.

The left driving tine 100 is opposite to the front end portion 107 of the inner auger blade 57 on the right auger shaft 46. The right driving tine 106 is opposite to the front end portion 107 of the inner auger blade 57 on the left auger shaft 45.

The proximal end portion 112 (see FIG. 2) of the right snow removing tine 120 is proximately opposite to the right exterior wall of the power transmission member 43. The bend 113 is opposite to a right peripheral wall portion 48*b* as a right half of a peripheral wall 48 of the power transmission member 43.

Figure 9:
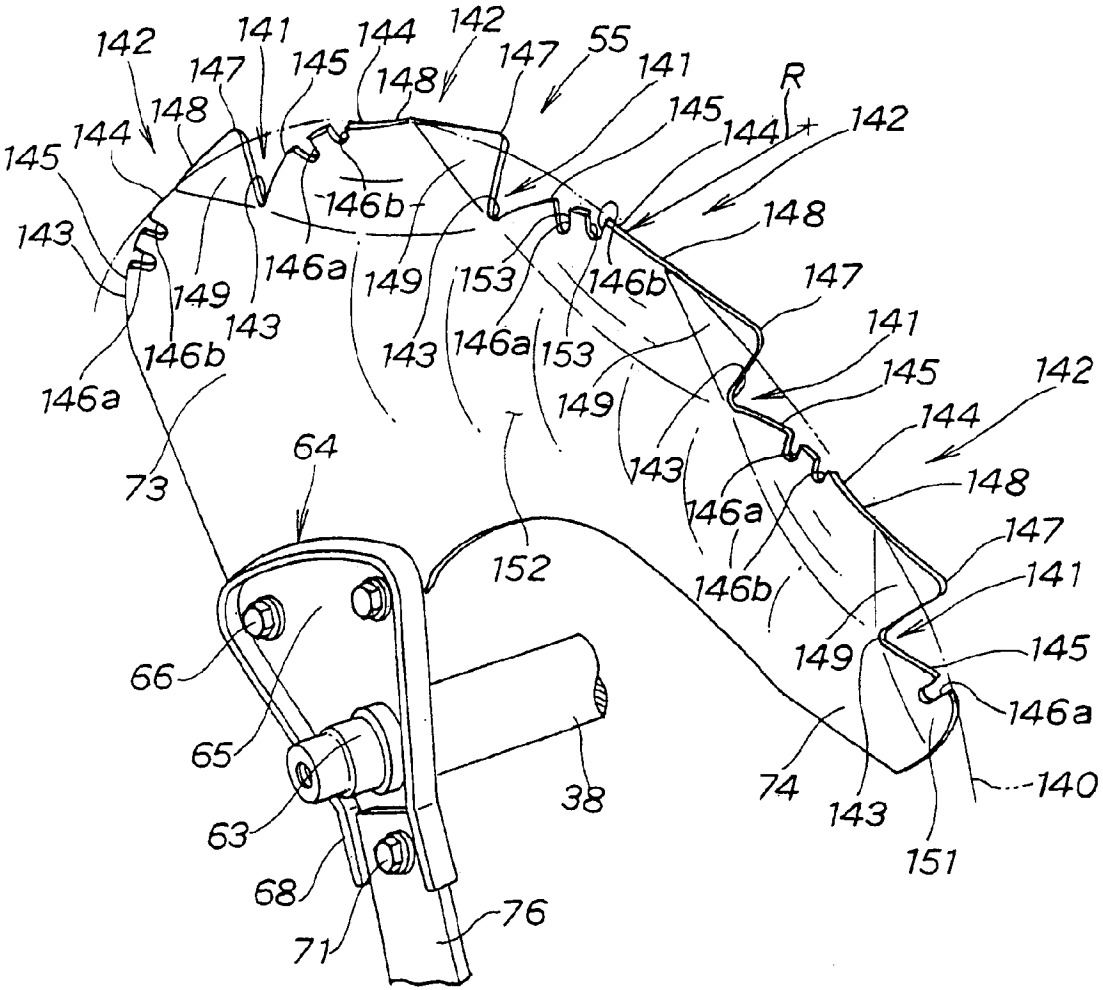
FIG. 9 is a perspective view of the outer auger blade shown in FIG. 2.

FIG. 9 illustrates the outer auger blade according to the present invention. Description will be made on the outer auger blade 55 by way of example. The intermediate auger blade 56 and inner auger blade 57 have the same configuration and will not be described.

The outer auger blade 55 is formed with four cutting blades 142 in its periphery 140, having four substantially V-shaped notches 141 formed at predetermined intervals.

The four cutting blades 142 are each formed between a front end 143 as a trough of the notch 141 and a rear end 147 as a crest of the notch 141 in the direction of the rear end portion 74 of the outer auger blade 55. The cutting blades 142 are curved laterally outward with radius R, for example.

The cutting blades 142 each include a cutting-in blade 145 formed between the front end 143 and a central part 144 between the front end 143 and the rear end 147, and a cutting-off blade 148 formed between the central portion 144 and the rear end 147.

The cutting-in blade 145 is curved radially outward of the periphery 140, having two saw tooth 146*a*, 146*b*.

The cutting-off blade 148 has at its rear end portion a bent-back blade 149 bent inward in the transverse direction of the snow removal machine.

The saw tooth 146*a*, 146*b* are formed in the cutting-in blade 145 by forming depressions 153, 153 in the cutting-in blade 145.

The rear end portion 74 of the outer auger blade 55 only has a front end portion 151 of the cutting-in blade 145.

The area of the outer auger blade 55 between the front end portion 73 and the rear end portion 74 constitutes a curved reinforcing portion 152 protrudes laterally outward in a curve along the periphery 140. The curved reinforcing portion 152 contributes strength to the outer auger blade 55.

The reason why the cutting blades 142 are formed in the periphery 140 of the outer auger blade 55, the front halves of the cutting blades 142 constitute the cutting-in blades 145, and the cutting-in blades 145 are formed with the saw tooth 146*a*, 146*b* will be described with reference to FIGS. 13A to 13C.

Figure 10:
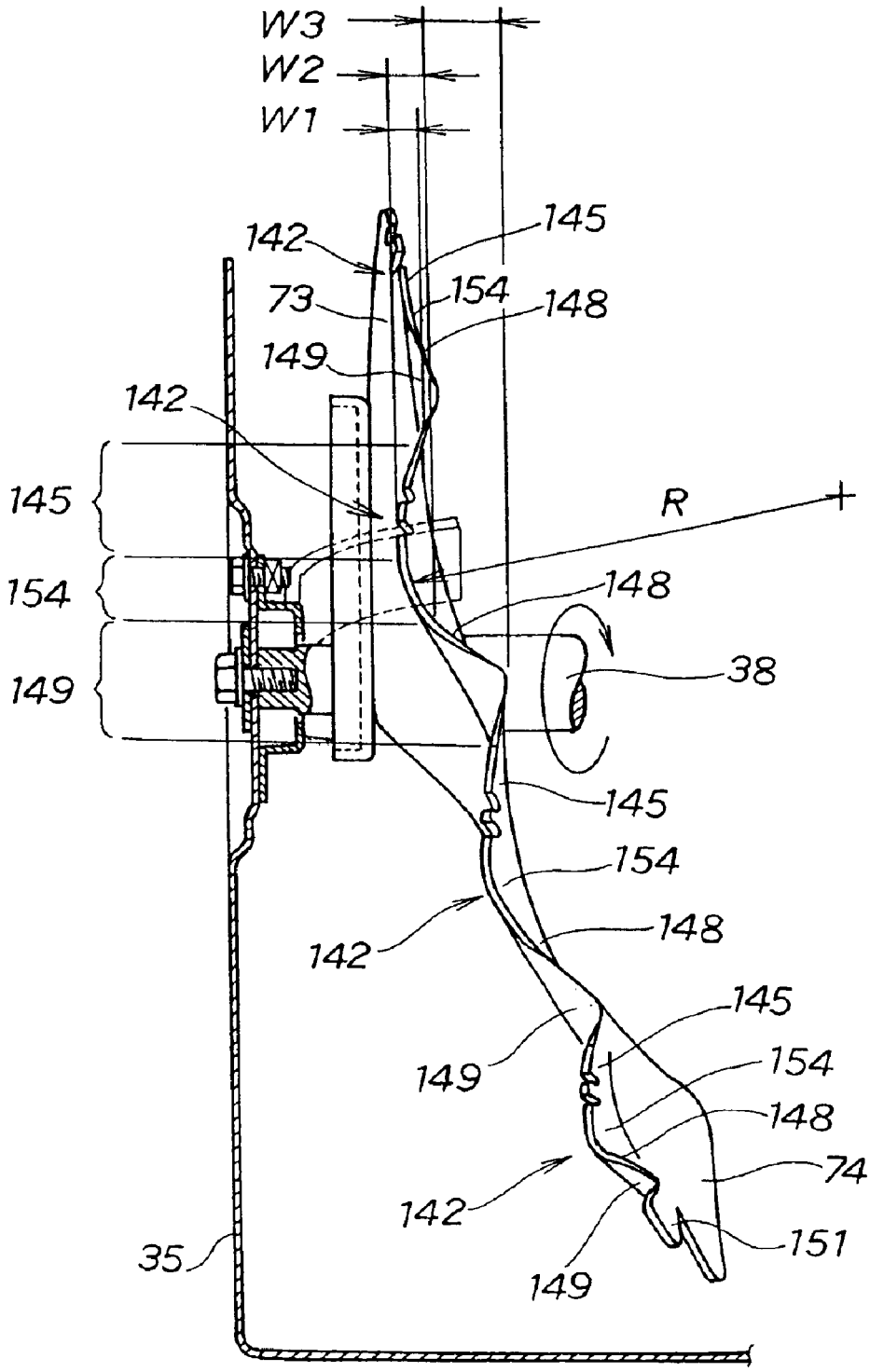
FIG. 10 is a plan view of the outer auger blade shown in FIG. 2.

FIG. 10 illustrates the outer auger blade 55 in a plan view.

The cutting blades 142 are curved laterally outward with radius R, for example. By curving the cutting blades 142 laterally outward with radius R, the cutting-in blades 145 constituting the front halves of the cutting blades 142 have the thickness of W1, portions 154 of the cutting-off blades 148 constituting the rear halves of the cutting blades 142 except the bent-back blades 149 have the thickness of W2, and the bent-back blades 149 have the thickness of W3.

The portions 154 overlap the cutting-in blades 145 in the longitudinal direction. The bent-back blades 149 are continuously arranged inside of the portions 154.

The reason why the bent-back blades 149 are formed at the rear ends of the cutting-off blades 148 will be described with reference to FIGS. 13A to 13B.

This embodiment has been described with the example of curving the cutting-off blades 142 laterally outward in an arc with radium R. The curved shape is not limited to the arc shape and may be formed in a desired curve.

Now, the function of the snow removal machine will be described with reference to FIGS. 11A to 14.

FIGS. 11A to 11F schematically illustrate the outer auger blade 55, intermediate auger blade 56 and inner auger blade 57.

Figure 11A:
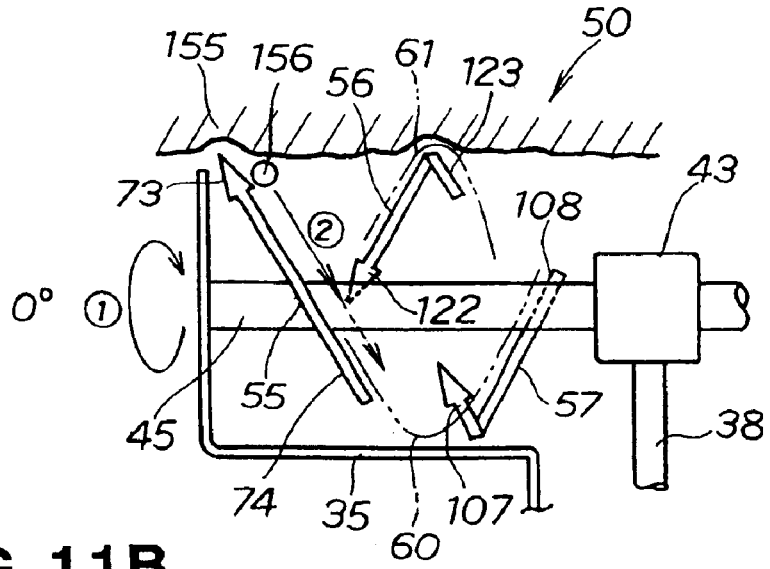
FIGS. 11A to 11F are schematic diagrams of an outer auger blade, intermediate auger blade and inner auger blade constituting a left auger provided on a left auger shaft, illustrating breaking of snow with the blades.

As shown in FIG. 11A, the outer auger blade 55 and the inner auger blade 57 are arranged along the common first helical path 60, and the intermediate auger blade 56 is arranged along the second helical path 61 approximately 180° out of phase with the first helical path 60.

The left auger 50 is rotated via the left auger shaft 45 as shown by arrow ①, breaking snow 155 with the outer auger blade while breaking the snow 155 with the intermediate auger blade 56.

A snow body 156 cut off by the outer auger blade 55 is sent along the outer auger blade 55 as shown by arrow ②.

Figure 11B:
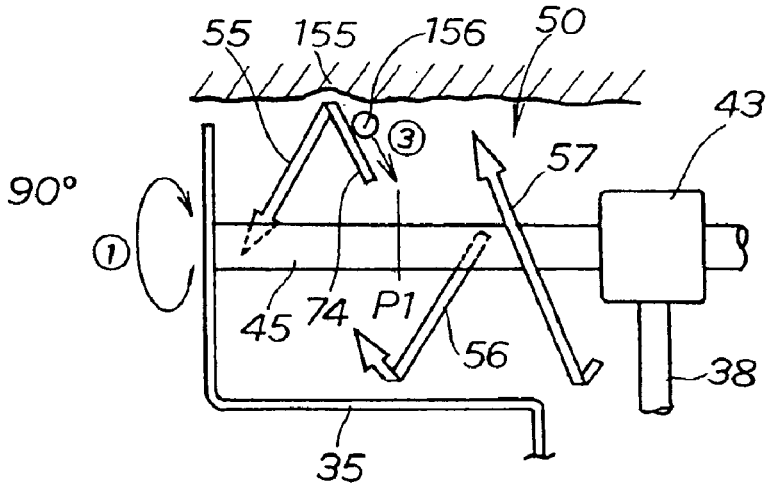

Referring to FIG. 11B, the left auger 50 is rotated 90° via the left auger shaft 45 in the direction of arrow ①. The outer auger blade 55 continuously breaks the snow 155 while the snow body 156 sent midway along the outer auger blade 55 is continuously sent along the outer auger blade 55 as shown by arrow ③ to a location P1 corresponding to the rear end portion 74 of the outer auger blade 55.

Figure 11C:
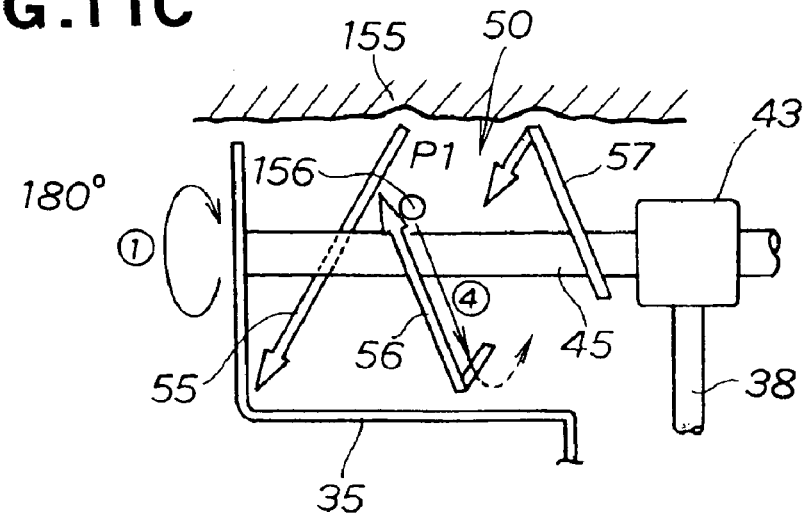

Referring to FIG. 11C, the left auger 50 is rotated 180° via the left auger shaft in the direction of arrow ①. The outer auger blade 55 finishes breaking the snow 155, and the inner auger blade 57 starts breaking the snow 155.

On the other hand, the snow body 156 carried to the location P1 by the outer auger blade 55 is received by the intermediate auger blade 56 and is sent as shown by arrow ④ along the intermediate auger blade 56.

Figure 11D:
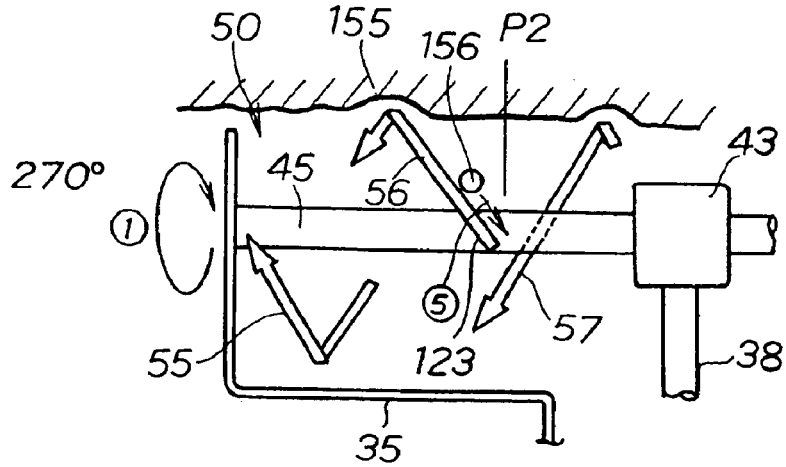

Referring to FIG. 11D, the left auger 50 is rotated 270° via the left auger shaft 45 in the direction of arrow ①. The inner auger blade 57 continuously breaks the snow 155 and the intermediate auger blade 56 also breaks the snow 155.

On the other hand, the snow body 156 carried midway along the intermediate auger blade 56 is continuously sent along the intermediate auger blade 56 to a location P2 corresponding to the rear end portion 123 of the intermediate auger blade 456 as shown by arrow ⑤.

Figure 11E:
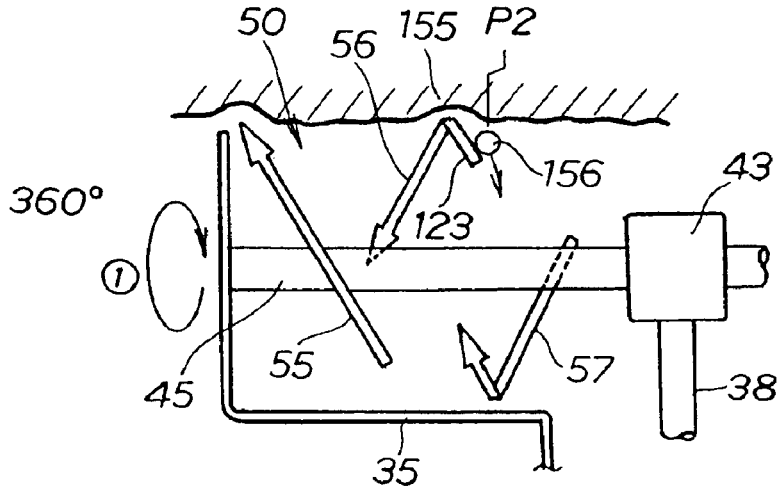

Referring to FIG. 11E, the left auger 50 is rotated 360° via the left auger shaft 45 in the direction of arrow ①. The inner auger blade 57 finishes breaking the snow 155 while the intermediate auger blade 56 breaks the snow 155.

On the other hand, the snow body 156 carried by the intermediate auger blade 56 reaches the location P2 corresponding to the rear end portion 123 of the intermediate auger blade 56.

Figure 11F:
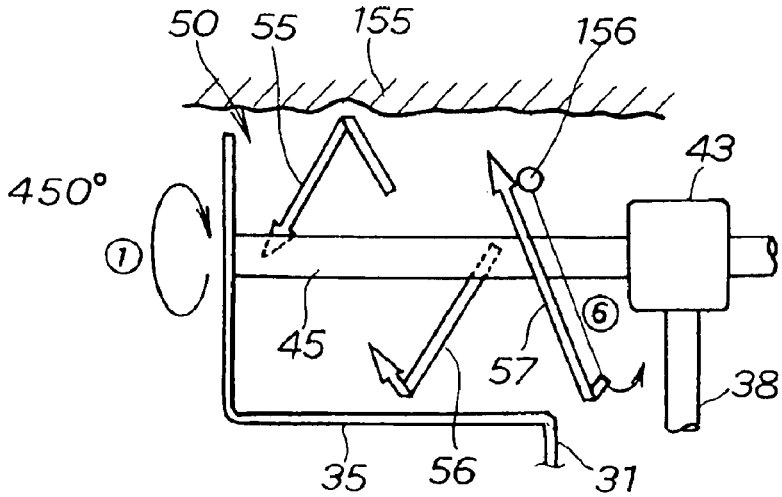

Referring to FIG. 11F, the left auger 50 is rotated 450° in the direction of arrow ① via the left auger shaft 45. The intermediate auger blade 56 finishes breaking the snow 155 and the outer auger blade 55 breaks the snow 155.

On the other hand, the snow carried to the location P2 (see FIG. 11E) by the intermediate auger blade 56 is received by the inner auger blade 57 and is sent along the inner auger blade 57 as shown by arrow ⑥.

In this manner, the snow body 156 cut off by the outer auger blade 55 is carried to the inner auger blade 57 via the intermediate auger blade 56 and is collected by the inner auger blade 57 to the blower housing 31 located in the center in the transverse direction.

Since the outer auger blade 55 and the inner auger blade 57 are arranged along the common first helical path 60 (see FIG. 11A) and the intermediate auger blade 56 is arranged along the second helical path 61 (see FIG. 11A), when the outer auger blade 55 or the inner auger blade 57 breaks the snow 155, the intermediate auger blade 56 can also break the snow 155 at the same time, resulting in efficient breaking of the snow 155.

Figure 12A:
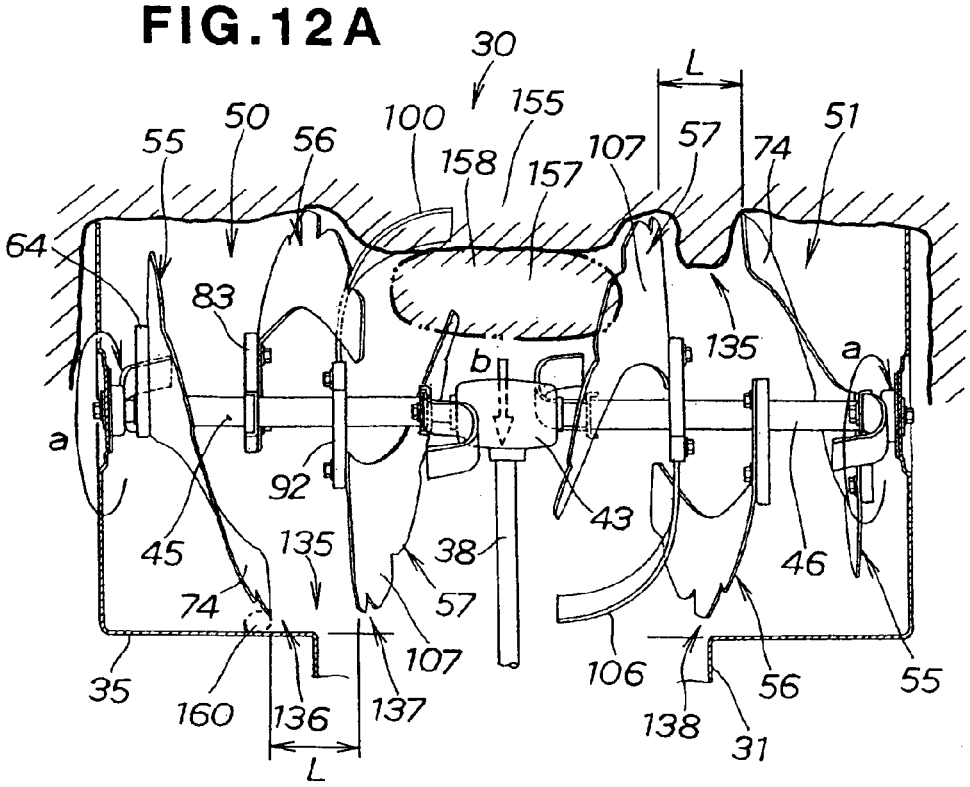
FIGS. 12A and 12B are diagrams illustrating a left driving tine and a right inner auger blade catching hold of snow.
Figure 12B:
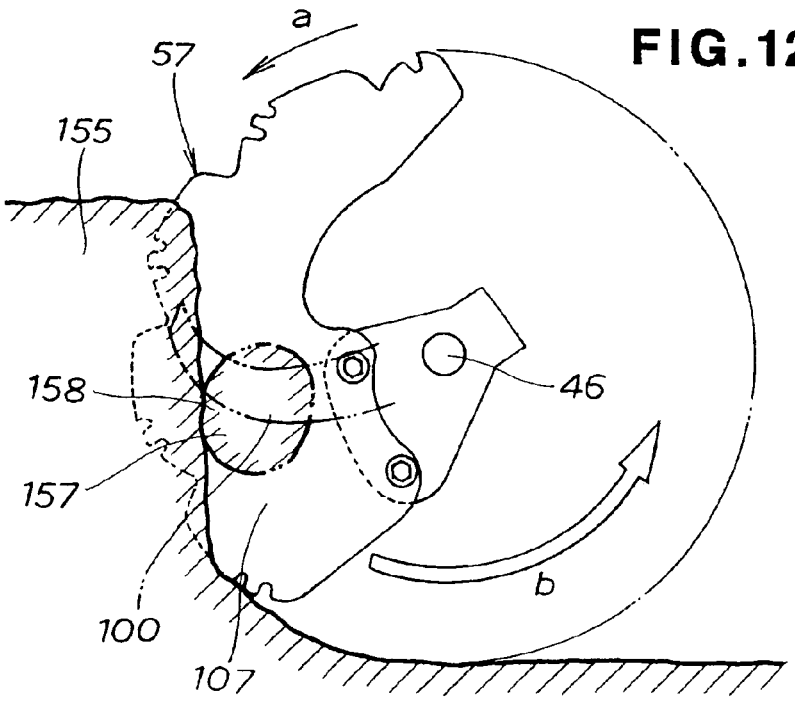

FIGS. 12A and 12B illustrate the snow removing operation by the auger device 30 according to the present invention and operation thereof when a foreign matter is caught in between a blade and the auger housing 35.

When the left auger 50 is rotated as shown by arrow "a" via the left auger shaft 45, the right auger 51 is also rotated as shown by arrow "a" via the right auger shaft 46. Like the left and right augers 50 and 51, the left and right driving tines 100 and 106 are rotated in the direction of arrow "a," cutting into the snow 155.

The left and right driving tines 100 and 106 cutting into the snow 155 break up a mass in the snow 155 by the impact force, efficiently breaking up the snow 155.

The left and right driving tines 100 and 106 biting into the snow 155 also serve as anchors, preventing the left and right augers 50 and 51 from lifting.

As described above, the left driving tine 100 is arranged opposite to the front end portion 107 of the inner auger blade 57 provided on the right auger shaft 46, and the right driving tine 106 is arranged opposite to the front end portion 107 of the inner auger blade 57 provided on the left auger shaft 45.

A mass of snow 157 in front of the power transmission member 43 disposed centrally in the transverse direction is caught between the left driving tine 100 and the inner auger blade 57 on the right auger shaft 46 and carried rearward as shown by arrow "b," and then caught between the right driving tine 106 and the inner auger blade 57 on the left auger shaft 45 and carried rearward as shown by arrow "b."

As described with reference to FIGS. 11A to 11F, the snow 158 collected to the front of the power transmission member 43 by the left and right augers 50 and 51 (identical to the snow mass 157 for descriptive convenience) is caught between the left driving tine 100 and the inner auger blade 57 on the right auger shaft 46 and carried rearward as shown by arrow "b," and then caught between the right driving tine 106 and the inner auger blade 57 on the left auger shaft 45 and carried rearward as shown by arrow "b."

Since the blower 40 (see FIG. 1) is provided centrally in the transverse direction behind the left and right augers 50 and 51, the snow mass 157 lying centrally in the transverse direction and the snow 158 collected to the center are efficiently sent to the blower 40, resulting in an increase in snow removing workability.

The left auger 50 is divided into three parts, the outer auger blade 55, intermediate auger blade 56 and inner auger blade 57. The right auger 51 is divided into three parts, the outer auger blade 55, intermediate auger blade 56 and inner auger blade 57. The auger blades 55, 56 and 57 are therefore each formed in a small size and mounted on the auger shaft 45 only at a single point via the supporting members 64, 83 and 92, respectively.

When a foreign matter 160 such as a stone is caught in a gap 136 between the outer auger blade 55 and the auger housing 35, for example, the outer auger blade 55 is plastically deformed. The foreign matter 160 can be released from between the outer auger blade 55 and the auger housing 35, with the left and right augers 50 and 51 kept rotating.

The intermediate auger blade 56 and the inner auger blade 57 can also release a foreign matter 160 in the same manner as the outer auger blade 55 does. It is thus avoided to catch a foreign matter 160 in the gap 136, 137 or 138 between the auger blade 55, 56 or 57 and the auger housing 35.

Also, when a foreign matter 160 is caught in the gap 136, 137 or 138 between the auger blade 55, 56 or 57 and the auger housing 35 and is not released naturally, an operator can plastically deform the auger blade 55, 56 or 57 to easily remove the foreign matter 160. The trouble of removing a foreign matter 160 caught in can be spared, resulting in an increased rate of operation of the auger device 30 for increased snow removing workability.

The rear end portion 74 of the outer auger blade 55 is laterally spaced from the front end portion 107 of the inner auger blade 57 with the clearance 135 of the predetermined interval L. When a foreign matter 160 enters the gap 136 between the outer auger blade 55 and the auger housing 35 or the gap 137 between the inner auger blade 57 and the auger housing 35, the foreign matter 160 is released through the clearance 135 between the rear end portion 74 of the outer auger blade 55 and the front end portion 107 of the inner auger blade 57, prevented from getting caught in.

Now, the function of the outer auger blade 55 will be described with reference to FIGS. 13A to 13C.

Figure 13A:
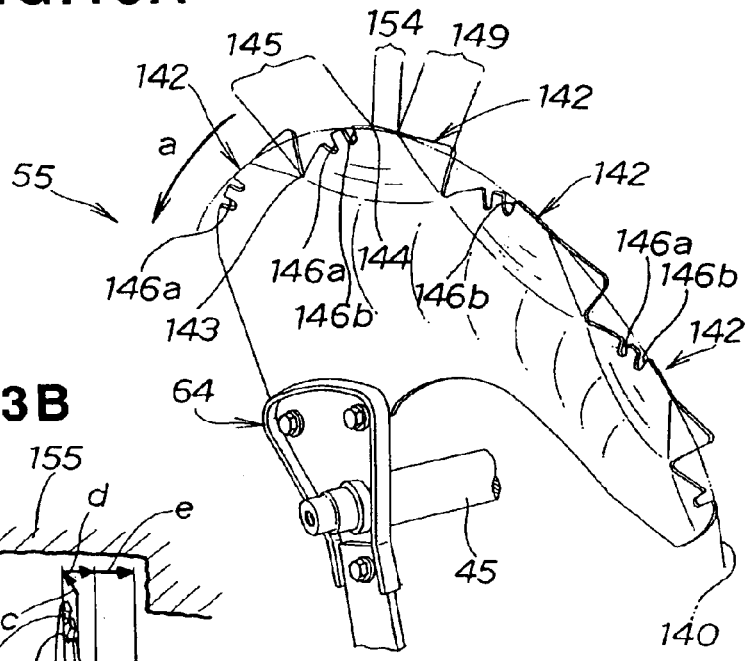
FIGS. 13A to 13C are diagrams illustrating breaking of snow with a plurality of cutting blades formed in an auger blade.
Figure 13B:
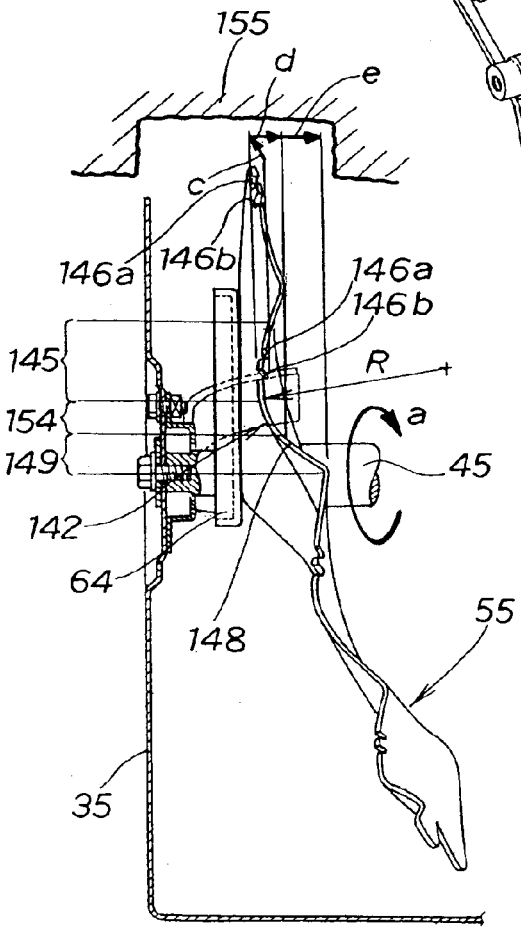

As the auger blade 55 shown in FIG. 13A rotates in a direction shown by arrow "a," the cutting-in blade 145 first cuts into snow (especially a mass of snow) 155, breaking the snow 155 in a direction shown by arrow "c" in FIG. 13B. At that time, as shown in i) in FIG. 13C, the snow 155 is cut off in a streak with the width of the thickness W1 of the cutting-in blade 145 shown in FIG. 10. At that time, a snow mass or icy solid snow is broken up by the saw tooth 146*a*, 146*b*.

After the cutting-in blade 145 breaks the snow 155, the portion 154 of the cutting-off blade 148 not including the bent-back blade 149 breaks into the snow 155. At that time, as described above, the portion 154, since overlapping the cutting-in blade 145, breaks the snow in a direction shown by arrow "d" in FIG. 13B, removing the rest of the streaked snow 155 generated when the cutting-in blade 145 breaks the snow 155 as described above. Then, as shown in ii) in FIG. 13C, the portion 154 breaks into the snow 155 with the width of the thickness W2. The portion 154 overlaps the cutting-in blade 145, thereby removing the streaked remaining snow 155, and increasing snow removal workability.

Sequentially, the bent-back blade 149 bent laterally inward breaks into the snow 155 in a direction shown by arrow "e" in FIG. 13B. Specifically, the snow 155 is continuously cut down as shown in iii) in FIG. 13C by a width corresponding to the thickness W3 of the bent-back blade 149 shown in FIG. 10.

Figure 13C:
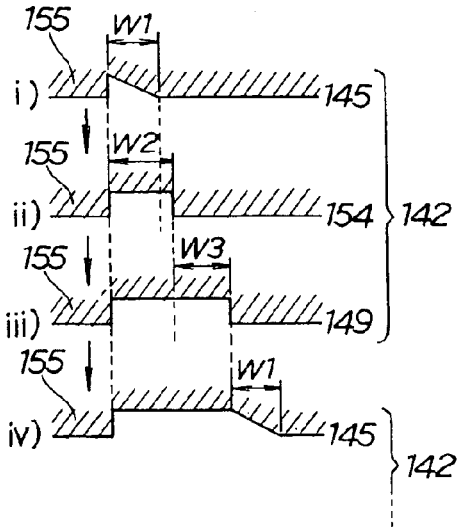

In summary, as shown in i) to iii) in FIG. 13C, the snow 155 is continuously cut down by the cutting-in blade 145, the portion 154 and the bent-back blade 149 in this order, which constitutes the cutting blade 142. This operation is repeated between the front end portion and the rear end portion of the outer auger blade 55 as shown in iv).

The present embodiment has been described with the example of overlapping only the portion 154 except the bent-back blade 149 of the cutting-off blade 148 with the cutting-in blade 145, which is not limiting. Both the portion 154 and the bent-back blade 149 may be overlapped with the cutting-in blade 145.

Figure 14:
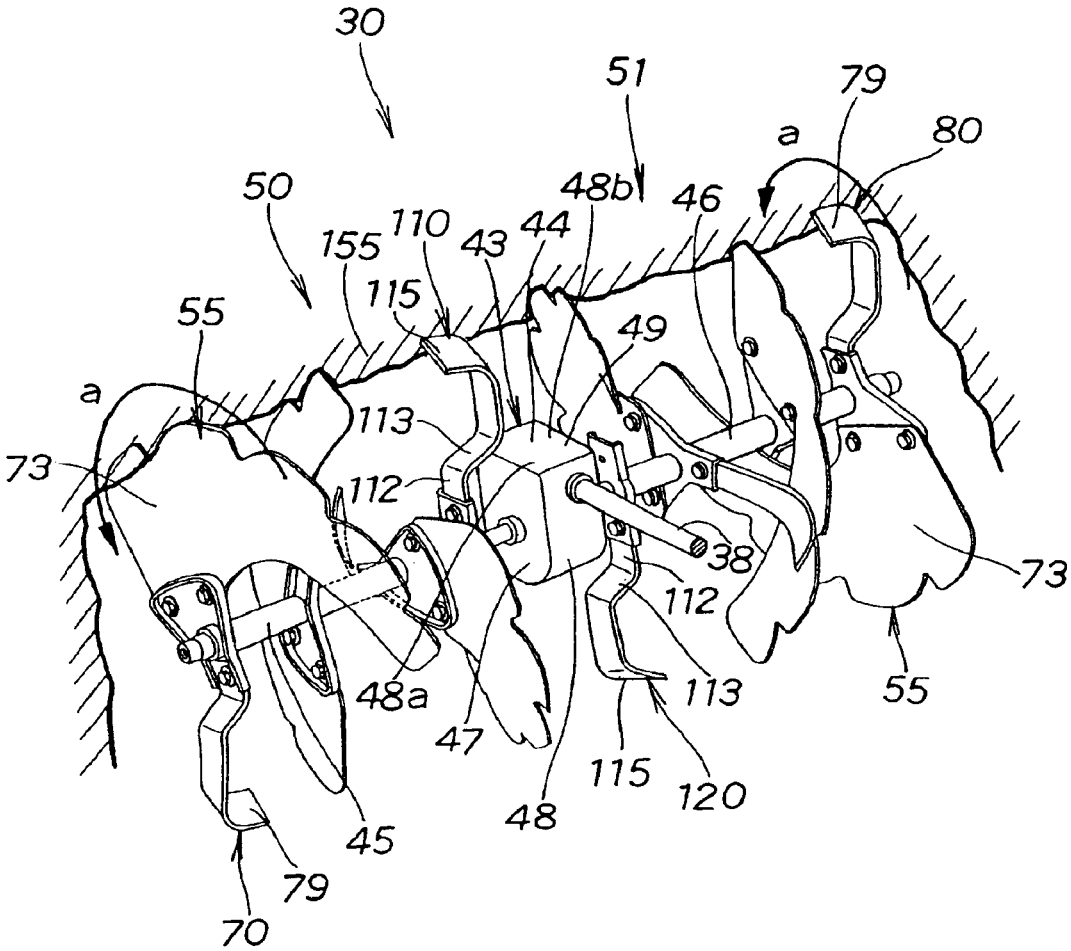
FIG. 14 is a diagram illustrating breaking of snow with the auger device stabilized in attitude by left and right attitude stabilizing tines.
Figure 15:
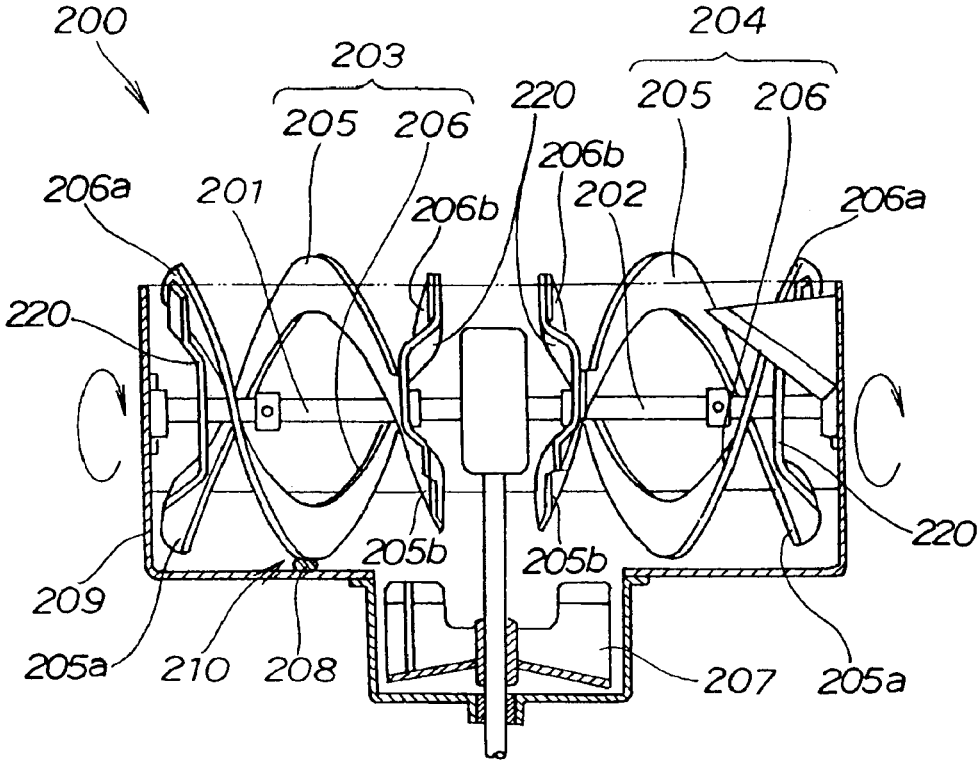
FIG.15 (PRIOR ART)
FIG. 15 is a plan view of a conventional auger device.

FIG. 14 illustrates the operation of the auger device 30.

As described above, the left attitude stabilizing tine 70 is provided in phase with the front end portion 73 of the outer auger blade 55 provided on the right auger shaft 46. The right attitude stabilizing tine 80 is provided in phase with the front end portion 73 of the outer auger blade 55 provided on the left auger shaft 45. When the front end portion 73 of the outer auger blade 55 on the left auger shaft 45 breaks the snow 155, the right attitude stabilizing tine 80 can simultaneously break into the snow 155. Likewise, when the front end portion 73 of the outer auger blade 55 on the right auger shaft 46 breaks the snow 155, the left attitude stabilizing tine 70 can simultaneously break into the snow 155.

A reaction force of substantially the same magnitude as that of the reaction force developed at the front end portion 73 of the left outer auger blade 55 when breaking into the snow 155 is developed at the right attitude stabilizing tine 80. Also, a reaction force of substantially the same magnitude as that of the reaction force developed at the front end portion 73 of the right outer auger blade 55 when breaking into the snow 155 is developed at the left attitude stabilizing tine 70. The reaction forces developed at the left and right augers 50 and 51 are thus balanced, thereby stabilizing the attitude of the auger device 30.

The left and right attitude stabilizing tines 70 and 80 prevent lifting of the left and right augers 50 and 51 as well as breaking up a snow mass in the snow 155 by impact force with the claws 79, 79 provided at their respective distal ends breaking into the snow 155, thus efficiently breaking the snow 155.

The left and right augers 50 and 51 are rotated as shown by arrows "a" via the left and right auger shafts 45 and 46, whereby the left snow removing tine 110 removes snow accumulating on the left peripheral wall portion 48*a* of left halves of the external walls 44 of the power transmission member 43. The right snow removing tine 120 removes snow accumulating on the right peripheral wall portion 48*b* of right halves of the external walls 44 of the power transmission member 43. While accumulation of snow on the external walls 44 of the power transmission member 43 is prevented, snow collected to the center in the transverse direction by the left and right augers 50 and 51 is efficiently carried to the blower 40 (see FIG. 1) behind the left and right augers 50 and 51, resulting in an increased snow removing efficiency.

The prevention of accumulation of snow on the external walls 44 of the power transmission member 43 eliminates any trouble in rotation of the left and right augers 51 and 51 and also eliminates any trouble in advancement of the auger device 30.

The elimination of troubles in rotation of the left and right augers 50 and 51 and the advancement of the auger device 30 ensures the breaking of the left and right augers 50 and 51 into the snow surface, increasing a snow removing efficiency.

The left and right snow removing tines 110 and 120 can break a snow mass in the snow 155 by impact force with the claws 115, 115 provided at the respective distal ends breaking into the snow 155, efficiently breaking the snow 155, as well as preventing the left and right augers 50 and 51 from lifting.

The embodiment shown in FIG. 2 has been described with the example of forming the left and right attitude stabilizing tines 70 and 80 in a substantially U shape with the outward bends 77, extensions 78 and claws 79, which is not limiting. The left and right attitude stabilizing tines 70 and 80 may be formed in a desired shape.

Also, the embodiment has been described with the example of forming the left and right driving tines 100 and 106 in a curved shape with the curved claws 102, 102, which is not limiting. The left and right driving tines 100 and 106 may be formed in a desired shape.

Further, the embodiment has been described with the example of forming the left and right snow removing tines 110 and 120 in a substantially U shape with the inward bends 113, extensions 114 and claws 115, which is not limiting. The left and right snow removing tines 110 and 120 may be formed in a desired shape.

The embodiment has been described with the example in which the left driving tine 100 is provided in the vicinity of the inner auger blade 57 on the left auger shaft 45, being out of phase with the inner auger blade 57, and the right driving tine 106 is provided in the vicinity of the inner auger blade 57 on the right auger shaft 46, being out of phase with the inner auger blade 57. It is also possible to provide the left driving tine 100 at a desired position on the left auger shaft 45 and to provide the right driving tine 106 at a desired position on the right auger shaft 46.

Obviously, various minor changes and modifications of the present invention are possible in the light of the above teaching. It is therefore to be understood that within the scope of the appended claims the invention may be practiced otherwise than as specifically described.

What is claimed is:

1. A snow removal machine comprising:

left and right auger shafts mounted to undergo rotation about respective rotational axes thereof, the auger shafts extending horizontally from a transverse center of the snow removal machine in respective leftward and rightward directions;

a left auger having an outer helical auger blade, an intermediate helical auger blade and an inner helical auger blade mounted on the left auger shaft for rotation therewith and extending sequentially from an end of the left auger shaft toward the transverse center of the snow removal machine for collecting snow toward the transverse center of the snow removal machine, the outer helical auger blade and the inner helical auger blade being disposed along a common first helical path and spaced-apart from one another along the rotational axis of the left auger shaft, and the intermediate helical auger blade being disposed along a second helical oath angularly shifted substantially 180 degrees with respect to the first helical path; and a right auger having an outer helical auger blade, an intermediate helical auger blade and an inner helical auger blade mounted on the right auger shaft for rotation therewith and extending sequentially from an end of the right auger shaft toward the transverse center of the snow removal machine for collecting snow toward the transverse center of the snow removal machine, the outer helical auger blade and the inner helical auger blade of the right auger being disposed along a common first helical path and spaced-apart from one another along the rotational axis of the right auger shaft, and the intermediate helical auger blade of the right auger being disposed along a second helical path angularly shifted substantially 180 degrees with respect to the first helical path of the outer and inner helical auger blades of the right auger.

2. A snow removal machine according claim 1; wherein when viewing the left auger in a direction along the rotational axis of the left auger shaft, the inner and outer helical auger blades of the left auger are displaced 120 degrees around the left auger shaft and the intermediate and inner helical auger blades of the left auger are displaced 120 degrees around the left auger shaft; and wherein each of the outer, inner and intermediate helical auger blades of the left auger has a peripheral angle of approximately 150 degrees so that a rear end portion of the outer helical auger blade overlaps a front end portion of the inner helical auger blade, a rear end portion of the inner helical auger blade overlaps a front end portion of the intermediate helical auger blade, and a rear end portion of the intermediate helical auger blade overlaps a front end portion of the outer helical auger blade.

3. A snow removal machine according claim 2; wherein when viewing the right auger in a direction along the rotational axis of the right auger shaft, the inner and outer helical auger blades of the right auger are displaced 120 degrees around the right auger shaft and the intermediate and inner helical auger blades of the right auger are displaced 120 degrees around the right auger shaft; and wherein each of the outer, inner and intermediate helical auger blades of the right auger has a peripheral angle of approximately 150 degrees so that a rear end portion of the outer helical auger blade overlaps a front end portion of the inner helical auger blade, a rear end portion of the inner helical auger blade overlaps a front end portion of the intermediate helical auger blade, and a rear end portion of the intermediate helical auger blade overlaps a front end portion of the outer helical auger blade.

4. A snow removal machine according to claim 3; wherein the left auger has an attitude stabilizing tine mounted on the left auger shaft in the vicinity of the outer helical auger blade of the left auger and arranged approximately 180 degrees out of phase with the front end portion of the outer helical auger blade of the left auger and having a curved claw portion at a distal end of the attitude stabilizing tine which bends toward the front end portion of the outer helical auger blade of the right auger, a driving tine mounted on the left auger shaft in the vicinity of the inner helical auger blade of the left auger and arranged approximately 180 degree out of phase with the front end portion of the inner helical auger blade of the left auger and having a curved claw portion at a distal end of the driving tine which bends toward the front end portion of the inner helical auger blade of the right auger, and a snow removing tine mounted on the left auger shaft and disposed inwardly of the inner helical auger blade of the left auger and having a curved claw portion at a distal end of the snow removing tine which bends away from the right auger.

5. A snow removal machine according to claim 4; wherein the right auger has an attitude stabilizing tine mounted on the right auger shaft in the vicinity of the outer helical auger blade of the right auger and arranged approximately 180 degrees out of phase with the front end portion of the outer helical auger blade of the right auger and having a curved claw portion at a distal end of the attitude stabilizing tine which bends toward the front end portion of the outer helical auger blade of the left auger, a driving tine mounted on the right auger shaft in the vicinity of the inner helical auger blade of the right auger and arranged approximately 180 degree out of phase with the front end portion of the inner helical auger blade of the right auger and having a curved claw portion at a distal end of the driving tine which bends toward the front end portion of the inner helical auger blade of the left auger, and a snow removing tine mounted on the right auger shaft and disposed inwardly of the inner helical auger blade of the right auger and having a curved claw portion at a distal end of the snow removing tine which bends away from the left auger.

6. A snow removal machine according to claim 1; wherein each of the outer helical auger blade, the intermediate helical auger blade and the inner helical auger blade of each of the left and right augers has a plurality of cutting blades formed in an outer peripheral edge thereof, the cutting blades being curved laterally outward so that for each of the outer, intermediate and inner helical auger blades of each of the left and right augers, adjacent cutting blades overlap with each other in a direction generally perpendicular to the rotational axis of the respective left and right auger shafts.

7. A snow removal machine according to claim 6; wherein for each of the outer, intermediate and inner helical auger blades of each of the left and right augers, each of the cutting blades has a cutting-in blade portion extending from a front end to a central portion of the cutting blade and a cutting-off blade portion extending from the central portion to a rear end of the cutting blade, the cutting-in blade portion having a plurality of saw teeth, and the cutting-off blade portion having a blade portion at a rear end thereof bent inwardly in a direction generally transverse to the rotational axis of the corresponding one of the left and right auger shafts.

8. A snow removal machine comprising:

a body having a central axis;

a blower housing mounted on the body so as to surround the central axis of the body;

a first auger shaft mounted to undergo rotation relative to the body about a rotational axis, the first auger shaft extending in a first direction generally transverse to the central axis of the body;

a first auger having an outer helical auger blade, an intermediate helical auger blade and an inner helical auger blade mounted on the first auger shaft for rotation therewith and extending sequentially from an end of the first auger shaft toward the central axis of the body for directing snow toward the blower housing, the outer helical auger blade and the inner helical auger blade being disposed along a common first helical path and spaced-apart from one another along the rotational axis of the first auger shaft, and the intermediate helical auger blade being disposed along a second helical path angularly shifted substantially 180 degrees with respect to the first helical path;

a second auger shaft mounted to undergo rotation relative to the body about a rotational axis, the second auger shaft extending in a second direction opposite the first direction and generally transverse to the central axis of the body; and a second auger having an outer helical auger blade, an intermediate helical auger blade and an inner helical auger blade mounted on the second auger shaft for rotation therewith and extending sequentially from an end of the second auger shaft toward the central axis of the body for directing snow toward the blower housing, the outer helical auger blade and the inner helical auger blade of the second auger being disposed along a common first helical path and spaced-apart from one another along the rotational axis of the second auger shaft, and the intermediate helical auger blade of the second auger being disposed along a second helical path angularly shifted substantially 180 degrees with respect to the first helical path of the outer and inner helical auger blades of the second auger.

9. A snow removal machine according claim 8; wherein when viewing the first auger in a direction along the rotational axis of the first auger shaft, the inner and outer helical auger blades of the first auger are displaced 120 degrees around the first auger shaft and the intermediate and inner helical auger blades of the first auger are displaced 120 degrees around the first auger shaft; and wherein each of the outer, inner and intermediate helical auger blades of the first auger has a peripheral angle of approximately 150 degrees so that a rear end portion of the outer helical auger blade overlaps a front end portion of the inner helical auger blade, a rear end portion of the inner helical auger blade overlaps a front end portion of the intermediate helical auger blade, and a rear end portion of the intermediate helical auger blade overlaps a front end portion of the outer helical auger blade.

10. A snow removal machine according claim 9; wherein when viewing the second auger in a direction along the rotational axis of the second auger shaft, the inner and outer helical auger blades of the second auger are displaced 120 degrees around the second auger shaft and the intermediate and inner helical auger blades of the second auger are displaced 120 degrees around the second auger shaft; and wherein each of the outer, inner and intermediate helical auger blades of the second auger has a peripheral angle of approximately 150 degrees so that a rear end portion of the outer helical auger blade overlaps a front end portion of the inner helical auger blade, a rear end portion of the inner helical auger blade overlaps a front end portion of the intermediate helical auger blade, and a rear end portion of the intermediate helical auger blade overlaps a front end portion of the outer helical auger blade.

11. A snow removal machine according to claim 10; wherein the first auger has an attitude stabilizing tine mounted on the first auger shaft in the vicinity of the outer helical auger blade of the first auger and arranged approximately 180 degrees out of phase with the front end portion of the outer helical auger blade of the first auger and having a curved claw portion at a distal end of the attitude stabilizing tine which bends toward the front end portion of the outer helical auger blade of the second auger, a driving tine mounted on the first auger shaft in the vicinity of the inner helical auger blade of the first auger and arranged approximately 180 degree out of phase with the front end portion of the inner helical auger blade of the first auger and having a curved claw portion at a distal end of the driving tine which bends toward the front end portion of the inner helical auger blade of the second auger, and a snow removing tine mounted on the first auger shaft and disposed inwardly of the inner helical auger blade of the first auger and having a curved claw portion at a distal end of the snow removing tine which bends away from the second auger.

12. A snow removal machine according to claim 11; wherein the second auger has an attitude stabilizing tine mounted on the second auger shaft in the vicinity of the outer helical auger blade of the second auger and arranged approximately 180 degrees out of phase with the front end portion of the outer helical auger blade of the second auger and having a curved claw portion at a distal end of the attitude stabilizing tine which bends toward the front end portion of the outer helical auger blade of the first auger, a driving tine mounted on the second auger shaft in the vicinity of the inner helical auger blade of the second auger and arranged approximately 180 degree out of phase with the front end portion of the inner helical auger blade of the second auger and having a curved claw portion at a distal end of the driving tine which bends toward the front end portion of the inner helical auger blade of the first auger, and a snow removing tine mounted on the second auger shaft and disposed inwardly of the inner helical auger blade of the second auger and having a curved claw portion at a distal end of the snow removing tine which bends away from the first auger.

13. A snow removal machine according to claim 8; wherein each of the outer helical auger blade, the intermediate helical auger blade and the inner helical auger blade of each of the first and second augers has a plurality of cutting blades formed in an outer peripheral edge thereof, the cutting blades being curved laterally outward so that for each of the outer, intermediate and inner helical auger blades of each of the first and second augers, adjacent cutting blades overlap with each other in a direction generally perpendicular to the rotational axis of the respective first and second auger shafts.

14. A snow removal machine according to claim 13; wherein for each of the outer, intermediate and inner helical auger blades of each of the first and second augers, each of the cutting blades has a cutting-in blade portion extending from a front end to a central portion of the cutting blade and a cutting-off blade portion extending from the central portion to a rear end of the cutting blade, the cutting-in blade portion having a plurality of saw teeth, and the cutting-off blade portion having a blade portion at a rear end thereof bent inwardly in a direction generally transverse to the rotational axis of the corresponding one of the first and second auger shafts.

* * * * *